US005522459A

United States Patent [19]

Padgett et al.

[11] Patent Number: 5,522,459

[45] Date of Patent: Jun. 4, 1996

[54] CONTINUOUS MULTI-COMPONENT SLURRYING PROCESS AT OIL OR GAS WELL

[75] Inventors: Paul O. Padgett; Stephen F. Crain; Wayne A. Handke, all of Duncan, Okla.; Jerry L. Logan, Katy, Tex.; Calvin L. Stegemoeller, Duncan, Okla.; Ricky L. Covington, Duncan, Okla.; David W. Ritter, Duncan, Okla.; Kevin D. Edgley, Duncan, Okla.

[73] Assignee: Halliburton Company, Duncan, Okla.

[21] Appl. No.: 74,051

[22] Filed: Jun. 3, 1993

[51] Int. Cl.[6] ..... E21B 33/13

[52] U.S. Cl. ..... 166/285; 166/293; 507/100

[58] Field of Search ..... 166/285, 293, 166/295; 507/700

[56] References Cited

U.S. PATENT DOCUMENTS

| | | | |
|---|---|---|---|
| 3,161,203 | 12/1964 | Hathorn et al. | 137/8 |
| 3,245,584 | 4/1966 | Linville | 222/57 |
| 3,336,011 | 8/1967 | Futty . | |
| 3,379,421 | 4/1968 | Putman | 295/154 |
| 3,475,392 | 10/1969 | McCoy et al. | 260/83.7 |
| 3,606,903 | 9/1971 | Porter et al. | 137/88 |
| 3,609,316 | 9/1971 | Brosset et al. | 235/151.2 |
| 3,670,923 | 6/1972 | Hawes, Jr. et al. | 222/2 |
| 3,908,967 | 9/1975 | Merritt | 259/153 |
| 3,940,600 | 2/1976 | Alexander et al. | 235/151.12 |
| 4,003,431 | 1/1977 | Novotny et al. | 166/250 |
| 4,111,272 | 9/1978 | Ricciardi et al. | 177/50 |
| 4,111,335 | 9/1978 | Arya et al. | 222/57 |
| 4,111,336 | 9/1978 | Ward et al. | 222/58 |
| 4,209,258 | 6/1980 | Oakes | 366/138 |
| 4,265,266 | 5/1981 | Kierbow et al. | 137/101.19 |
| 4,327,759 | 5/1982 | Millis | 137/3 |
| 4,345,612 | 8/1982 | Koni et al. | 137/101.19 |
| 4,353,482 | 10/1982 | Tomlinson et al. | 221/1 |
| 4,410,106 | 10/1983 | Kierbow et al. | 222/135 |
| 4,424,559 | 1/1984 | Lorincz et al. | 364/131 |
| 4,427,133 | 1/1984 | Kierbow et al. | 222/77 |
| 4,430,828 | 2/1984 | Oglevee et al. | 47/17 |
| 4,474,204 | 10/1984 | West | 137/88 |
| 4,497,031 | 1/1985 | Froehling et al. | 364/505 |
| 4,498,783 | 2/1985 | Rudolph | 366/132 |
| 4,517,637 | 5/1985 | Cassell | 364/138 |
| 4,538,221 | 8/1985 | Crain et al. | 364/172 |
| 4,538,222 | 8/1985 | Crain et al. | 364/172 |
| 4,626,984 | 12/1986 | Unruh et al. | 364/132 |
| 4,628,436 | 12/1986 | Okamoto et al. | 364/131 |
| 4,654,802 | 3/1987 | Davis | 364/502 |
| 4,672,530 | 6/1987 | Schuss | 364/133 |

(List continued on next page.)

FOREIGN PATENT DOCUMENTS

| | | |
|---|---|---|
| 566739 | 4/1958 | Belgium . |
| 637629 | 3/1962 | Canada . |
| 0495098A1 | 9/1989 | European Pat. Off. . |
| 1391104 | 1/1964 | France . |
| 0003704 | 6/1979 | France . |
| 2532858 | 9/1982 | France . |
| 2247518 | 9/1972 | Germany . |
| 745249 | 7/1953 | United Kingdom . |
| 1177000 | 1/1970 | United Kingdom . |

OTHER PUBLICATIONS

SPE 19769—"Proppant Flowback Control", J. R. Murphey et al. (U.S.A. 1989).

"Treatment Stops Proppant Flowback in Coal Seam Wells", J. R. Murphey et al., *Petroleum Engineer*, pp. 21–23 (U.S.A. 1990).

(List continued on next page.)

*Primary Examiner*—Asok Pal
*Assistant Examiner*—Bekir L. Yildirim
*Attorney, Agent, or Firm*—Craig W. Roddy; Stephen R. Christian; E. Harrison Gilbert, III

[57] ABSTRACT

A continuous multi-component slurrying process at an oil or gas well comprises flowing at least three separate streams of different essential materials directly into a predetermined mixing unit at the oil or gas well, wherein each of the essential materials is required to obtain a predetermined defining characteristic of the slurry.

3 Claims, 22 Drawing Sheets

U.S. PATENT DOCUMENTS

| | | | |
|---|---|---|---|
| 4,715,721 | 12/1987 | Walker et al. | 366/132 |
| 4,764,019 | 8/1988 | Kaminski et al. | 366/15 |
| 4,779,186 | 10/1988 | Handke et al. | 364/172 |
| 4,850,750 | 7/1989 | Cogbill et al. | 406/82 |
| 4,872,763 | 10/1989 | Higuchi et al. | 366/160 |
| 4,886,367 | 12/1989 | Bragg et al. | 366/132 |
| 4,916,631 | 4/1990 | Crain et al. | 364/502 |
| 4,979,091 | 12/1990 | Albers | 364/148 |
| 5,003,814 | 4/1991 | Crawford et al. | 73/59 |
| 5,027,267 | 6/1991 | Pitts et al. | 364/172 |
| 5,046,855 | 9/1991 | Allen et al. | 366/137 |
| 5,103,908 | 4/1992 | Allen | 166/285 |
| 5,114,239 | 5/1992 | Allen | 366/6 |
| 5,190,374 | 3/1993 | Harms et al. | 366/165 |
| 5,281,023 | 1/1994 | Cedillo et al. | 366/17 |

OTHER PUBLICATIONS

U.S. Patent Application 07/974,391, entitled "Cement Mixing and Pumping System and Method for Oil/Gas Well" filed Nov. 10, 1992, P. N. Naegele et al. (attorney docket No. HS92.268A1).

"Precision Slurry Blender", Bulletin No. BJI–73–156, Byron–Jackson, Inc. (4 pages); believed published prior to May 1992.

"The RAM–Recirculating Averaging Mixer for Consistent Slurry Weight", BJ–Titan Services (6 pages); believed published prior to May 1992.

"POD Blender", TSL–5011, ICN–101675000, Dowel Schlumberger (5 pages); believed published prior to May 1992.

"RCM™ System", Halliburton Services (5 pages); believed published prior to May 1992.

"The Magcobar Cementing System", Magcobar Dresser Cementing Operations (1 page); believed published prior to May 1992.

"Western Offshore Cementing Services", Western Company of North America, (6 pages); believed published prior to May 1992.

U.S. Patent Application Ser. No. 07/822,189 entitled "Control System and Method", filed Jan. 16, 1992, Stanley v. Stephenson et al., (attorney docket No. HS91.261A1).

U.S. Patent Application Ser. No. 07/955,531 entitled "Method and Apparatus for Controlling a Device" filed Oct. 1, 1992, Thomas J. Worley et al. (attorney docket No. HS91.318A1).

A- LIGHTWEIGHT (< 14.0 LBS/GAL)
B- STANDARD SLURRIES
C- HIDENSE SLURRIES

| | |
|---|---|
| OSP | OPERATOR SETPOINT |
| RV | RATIO VARIABLE |
| PV | PROCESS VARIABLE |
| CSP | CONTROLLER SETPOINT |
| MC | MANUAL CONTROL SIGNAL |
| OUT_% | OUTPUT PERCENTAGE |
| OUT_SPAN | OUTPUT_SPAN = OUT_MAX-OUT_MIN |
| OUT_MIN | PROCESS MINIMUM |
| OUT_MAX | PROCESS MAXIMUM |
| DELTA | CONTROLLER INCREMENT TO ITS OUTPUT |
| OUT | OUTPUT OF CONTROLLER |
| INVALID_SP | FLAG FOR AN INVALID SETPOINT |
| OUTPUT_OFFSET | OUTPUT OFFSET FOR CONTROLLER |
| ERROR | ERROR OF PV FROM THE CSP |
| DEADBAND | DEADBAND ZONE AROUND SETPOINT |

| | |
|---|---|
| DAC_OUT_% | OUTPUT PERCENTAGE OF DAC |
| OUT_DAC 1 | OUTPUT VOLTAGE/CURRENT OF DAC 1 |
| OUT_DAC 2 | OUTPUT VOLTAGE/CURRENT OF DAC 2 |
| DAC 1_SPAN | VOLTAGE/CURRENT PER DAC 1 OUTPUT PERCENTAGE |
| DAC 2_SPAN | VOLTAGE/CURRENT PER DAC 2 OUTPUT PERCENTAGE |
| DAC 1_HOLD | NEUTRAL VALUE OF VOLTAGE/CURRENT FOR DAC 1 |
| DAC 2_HOLD | NEUTRAL VALUE OF VOLTAGE/CURRENT FOR DAC 2 |
| DAC 1_MIN | MINIMUM VOLTAGE/CURRENT VALUE FOR DAC 1 |
| DAC 2_MIN | MINIMUM VOLTAGE/CURRENT VALUE FOR DAC 2 |
| STATUS_FLAG | FLAG SENT TO SUPERVISOR TO NOTIFY IT OF CONTROLLER STATUS |

FIG. 10I

CONTINUOUS MULTI-COMPONENT SLURRYING PROCESS AT OIL OR GAS WELL

BACKGROUND OF THE INVENTION

This invention relates generally to an at least three primary stream continuous multi-component slurrying process at an oil or gas well. In a particular aspect, the invention is a process for providing and mixing continuous properly proportioned flows of multiple essential materials and multiple additives to produce cementitious slurries or drilling fluids.

A "cementitious slurry" as the term is used in this disclosure and in the accompanying claims encompasses mixtures that are made at an oil or gas well in a fluid state so that they can be pumped into the well but which ultimately harden in the well to provide sealing and compressive strength properties useful for known purposes in the well. For example, a settable mud is one type of cementitious slurry, and a cement is another type of cementitious slurry.

When a cementitious slurry is needed, a qualified person analyzes the particular situation and designs a particular slurry. Such a design includes a list of ingredients (the "recipe") and possibly one or more desired parameters (e.g., density). Such a design has at least one of what is referred to herein as a characteristic is the recipe of ingredients. For a cement, a defining characteristic is density.

The design is implemented at the well by mixing the ingredients in a manner to obtain the one or more defining characteristics. The ingredients that are mixed can be of two types: essential materials and additives. As used in this description and the accompanying claims defining the present invention, "essential materials" are ingredients that are required to obtain a particular defining characteristic of a slurry (i.e., someone making the slurry has to have the "essential materials" for the slurry to have the particular defining characteristics); "additives" are ingredients that modify or enhance the defining or other characteristics of the slurry. Any particular slurry will always have essential materials, but it may or may not have additives.

For the slurries and fluids to which the present invention is directed, there are always at least three essential materials for obtaining a defining characteristic. For example, a defining characteristic of a cement slurry is density; three essential materials for obtaining this characteristic are a hydrating fluid (e.g., fresh water, seawater, brine), a cementitious substance (e.g., cement), and a density control agent (e.g., fly ash). As a further example, a defining characteristic of a drilling fluid is also density; three essential materials for obtaining a desired density in a drilling fluid are a fluid medium (e.g., fresh water, seawater, brine, hydrocarbon fluid), a viscosity control agent (e.g., bentonite), and a density control agent (e.g., barite). As another example, a defining characteristic of a settable mud is the recipe itself; three essential materials for a settable mud recipe are a dilution fluid (e.g., fresh water, seawater, brine, hydrocarbon fluid), a drilling fluid such as referred to above, and a cementitious substance (e.g., cement, fly ash, blast furnace slag).

Although at least three essential materials are needed to obtain a defining characteristic of the type, and for the slurries, referred to herein, slurry mixing processes have typically provided for continuously mixing only two primary flows of essential material. Such limitation necessitates that other essential materials and additives be premixed with one of the two primary flows.

In typical present oil field cementing processes, a single liquid stream and a single dry stream are mixed into the desired cement slurry. An essential material of the liquid stream may be fresh water, for example, and an essential material of the dry stream is cement. When the third essential material is fly ash, for example, and when dry additives, such as retarders and dispersants, are used, they are preblended into the dry cement before continuous two-stream slurrification begins.

A shortcoming of such a preblending process is reduced flexibility in the logistics when cementing in remote locations. For example, offshore locations generally do not have blending facilities; hence, if dry additives are required, they must be blended with the cement at a land-based bulk plant and brought out prior to the job. Lack of homogeneity in the preblended dry materials is another shortcoming of this process because of potential poor performance of the cement downhole. That is, the physical and chemical properties of the cement slurry vary due to the lack of homogeneity and thus do not meet the job design criteria, whereby downhole performance deviations might occur.

Mixing of two flow streams is also used in settable mud systems. Although two essential liquids (drilling fluid and water), an essential dry material (the cementitious substance), and multiple lesser amount substances (dry and liquid additives for activating the cementitious substance and for controlling the slurry properties) may be used to produce a desired settable mud, the current practice is to premix the two essential liquids and all the additives in a large holding volume. A continuous mixing process is then used for adding the single essential dry material stream to a single fluid stream of the premixed substances.

A shortcoming of this two-stream settable mud slurrying process is that it requires space for a large storage facility (e.g., 400–800 barrels) to hold the combined volume of premixed substances prior to performing the two-stream slurrying process. Such a large space is typically not available on an offshore platform or ship; however, there is typically space at offshore locations for storing the individual components separately.

This two-stream settable mud slurrying process has other disadvantages, including: pretreated drilling fluid properties can deteriorate in the holding tanks (for example, adding a dispersant and/or dilution fluid to the drilling fluid causes solids to settle if adequate agitation is not provided, and many drilling rigs do not have adequately agitated pits); and the slurry design and testing must begin several days in advance of the placement downhole so that the drilling fluid can be treated, therefore last minute changes and "on-the-fly" changes cannot be made.

Cementitious slurrying, especially settable mud slurrying just referred to, is the primary context of the present invention. As mentioned above, however, a drilling fluid is typically used as a primary component of a settable mud slurry. A drilling fluid such as is used to flush drilled cuttings from the wellbore is not a cementitious slurry as that term is defined above; however, a drilling fluid is typically made using a principally two-stream process. For example, a fluid medium (e.g., water) can be pumped into a well as an initial drilling fluid. This mixes with downhole materials to form a mixture that flows to the surface where it is retained in a storage facility such as a pit or tank. A further drilling fluid is typically made by flowing a stream of the fluid medium (which may be provided as two streams, such as a water stream and a liquid hydrocarbon stream) and a stream of the mixture from the storage facility into a mixing unit. Control of the defining characteristic of this drilling fluid typically occurs by adding substances into the stream of mixture from the storage facility.

A shortcoming of this drilling fluid process is that the substances added to the mixture stream are input in doses so that correct proportioning does not occur until after mixing in the mixing unit for a sufficient period of time. That is, this prior process does not enable a continuous properly proportioned drilling fluid to be produced and used quickly. As a result, a drilling fluid that may be needed quickly must be made ahead of time and stored at the well site, which can create problems of the type referred to above concerning whether storage space is available and whether homogeneity can be maintained. For example, a relatively heavy drilling fluid referred to as "kill mud" may be required at a well site so that it can be pumped into a well to "kill" it if conditions warrant. With the prior process, kill mud has to be made and stored because the prior process cannot continuously produce it with the proper defining characteristic(s) at the time an emergency requiring it arises. This requires the kill mud to be stored somewhere at the well site; this permits changes to occur in the kill mud whereby it may not be suitable when it is needed; and this wastes materials and money and requires disposal procedures if the kill mud is not used.

In view of the foregoing, there is the need for an improved continuous multi-component slurrying process at an oil or gas well, particularly one providing continuous properly proportioned mixing of multiple essential materials and multiple additives to form cementitious slurries or drilling fluids at an oil or gas well site, whether onshore or offshore. That is, such a process should enable slurrying without requiring premixing. Although such a needed process might be manually controlled, it would be preferable to provide an automatic control method for the multi-component slurrying process.

SUMMARY OF THE INVENTION

The present invention overcomes the above-noted and other shortcomings of the prior art by providing a novel and improved continuous multi-component slurrying process at an oil or gas well. By this process multiple essential dry materials, multiple essential liquid materials, multiple dry additives, and multiple liquid additives can be mixed together continuously to form a desired slurry to be pumped into an oil or gas well. Although this complex mixing process can be controlled manually, an automatic control system is also disclosed.

Referring to the slurrying process, the present invention is broadly defined as a continuous multi-component slurrying process at an oil or gas well, comprising flowing at least three separate streams of different essential materials directly into a predetermined mixing unit at the oil or gas well, wherein each of the essential materials is required to obtain a predetermined defining characteristic of the slurry.

Specifically as to a settable mud, for example, one of the streams includes a dilution fluid for the slurry, another of the streams includes a cementitious substance for the slurry, and still another of the streams includes a drilling fluid for the slurry.

Specifically as to a cement, for example, one of the streams includes a hydrating fluid for the slurry, another of the streams includes a cementitious substance for the slurry, and still another of the streams includes a density control agent for the slurry.

Specifically as to a drilling fluid, for example, one of the streams includes a fluid medium for the slurry, another of the streams includes a viscosity control agent for the slurry, and still another of the streams includes a density control agent for the slurry.

The present invention can also be defined with reference to a process for making a slurry at an oil or gas well using a system providing for first and second streams flowed into a mixing unit of the system, wherein the first stream includes a stream of a first essential material and the second stream includes a stream of premixed substances including at least second and third essential materials. As to this, the present invention is defined as the improvement comprising providing for at least three continuous, properly proportioned flow streams directly into the mixing unit including: flowing the first essential material directly into the mixing unit; flowing an at least partially unpremixed stream directly into the mixing unit, wherein the at least partially unpremixed stream includes at least one, and only one, of the second and third essential materials; and flowing the other of the second and third essential materials directly into the mixing unit.

As limited specifically to a process for making a settable mud, the present invention provides a process for continuously mixing a settable mud at an oil or gas well, comprising: (a) flowing a dilution fluid directly into a mixing unit at the oil or gas well; (b) flowing a drilling fluid directly into the mixing unit; (c) flowing a cementitious substance directly into the mixing unit; and (d) mixing the dilution fluid, the drilling fluid and the cementitious substance in the mixing unit. This process can further comprise before steps (a), (b), (c) and (d): flowing a fluid medium into the mixing unit; flowing a viscosity control agent into the mixing unit; flowing a density control agent into the mixing unit; mixing the fluid medium, the viscosity control agent and the density control agent in the mixing unit into a drilling fluid to be pumped into the well; pumping the drilling fluid of the preceding step into the well; and returning at least a portion of the pumped drilling fluid from the well and flowing the returned portion into a storage facility; and wherein step (b) above includes using at least a portion of the drilling fluid from the storage facility. Using at least a portion of the drilling fluid from the storage facility includes conditioning at least a portion of the drilling fluid from the storage facility without substantially increasing the volume of the conditioned portion, and pumping the conditioned portion into the mixing unit.

Advantages of the continuous multi-component slurrying process of the present invention include:

1. Improved logistics. Essential materials and additives can be stored on location in their original form with no need to premix materials at a remote distribution facility and haul them out to the well site prior to each job.
2. Reduced/eliminated holding volume. There is no need to combine an essential material with one or more other essential materials or additives in a large holding volume prior to the job. This is particularly important in offshore applications.
3. Time savings. The slurry design can be adjusted and modified right up to the time for the slurry to be mixed and pumped. Immediate turnaround can be achieved (i.e., a desired slurry can be quickly produced in the correct proportions at the time it is needed).
4. Accuracy. Since there is no required premixing, homogeneity can be maintained. Additionally, accurate concentrations of the additives, also critical to the delivery of high quality jobs, can be maintained.

5. Reduced waste. A slurry can be made on an as needed basis so that large volumes of treated materials, which might ultimately not be used, do not need to be made in advance.

Therefore, from the foregoing, it is a general object of the present invention to provide a novel and improved continuous multi-component slurrying process at an oil or gas well. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIGS. 9A–9E are another flow chart for the control method for automatically controlling the process of the present invention.

FIGS. 10A–10I are a flow chart for an operate mode of the automatic control method.

DETAILED DESCRIPTION OF PREFERRED EMBODIMENTS

Process

Figure 1:
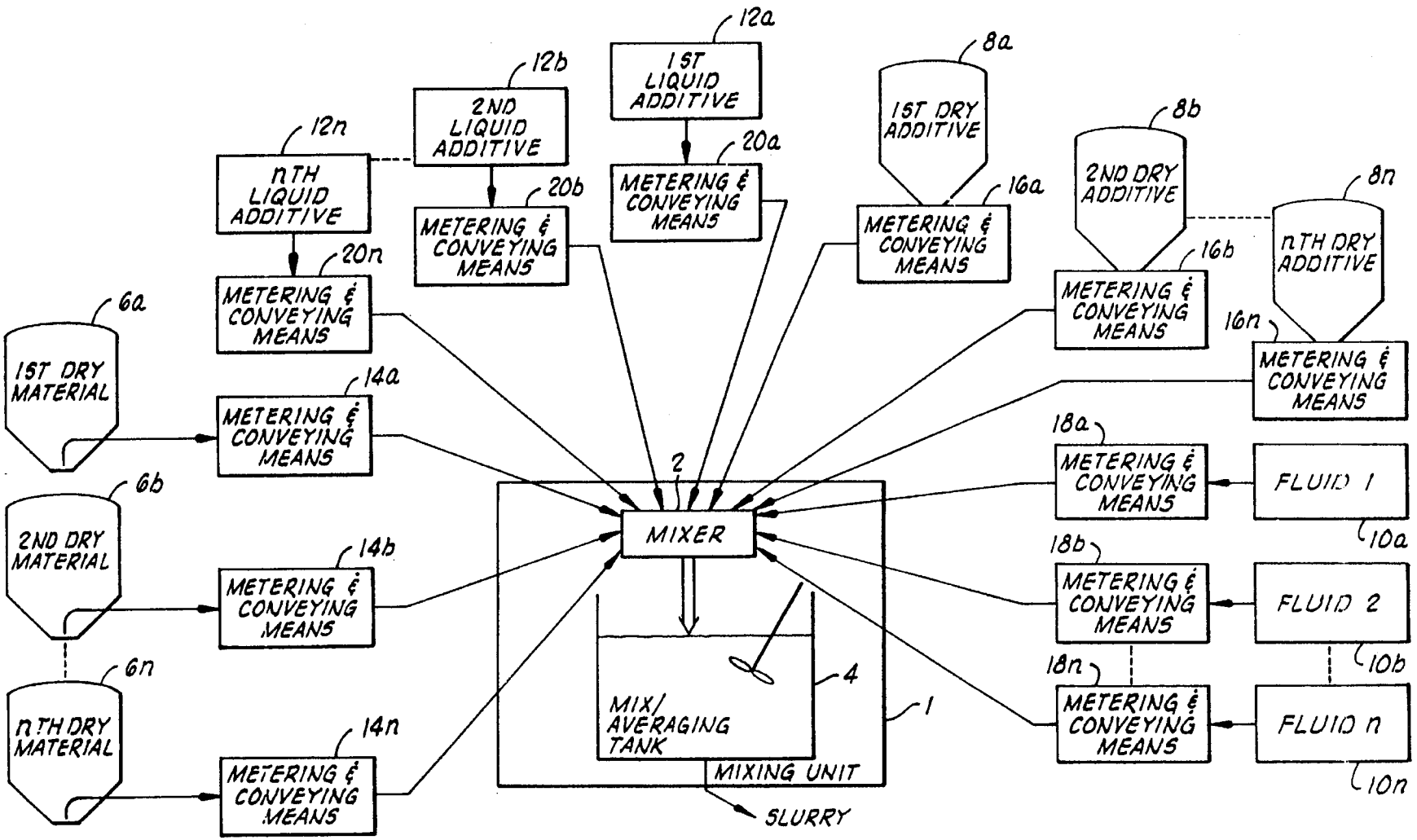
FIG. 1 is a block diagram of a general slurrying process of the present invention.

Referring to FIG. 1, in the general process of the present invention multiple streams of flowing substances flow directly into a mixing unit 1. In the FIG. 1 embodiment, the mixing unit 1 includes an inlet mixer 2 and an averaging container 4; however, other means can be used to implement the mixing unit 1. For example, an inlet mixer need not be used. The mixing unit 1 is where primary slurry mixing energy is applied to the slurry. As used herein, "mixing unit" does not include the means by which the separate inlet flows are provided. Also as used herein, "directly into the mixing unit" and the like do not encompass flow of one substance into a flow of another substance upstream or downstream of the mixing unit 1.

Without limiting the present invention, the following explanation will refer specifically to the inlet mixer 2/averaging container 4 implementation shown in FIG. 1 The averaging container 4 will subsequently be referred to simply as a tub, which is one form it can take; however, the averaging container 4 in general can also be a tank, pit or other predetermined volume where the inlet flows are received and mixed into a resultant slurry.

All the flows illustrated in FIG. 1 move through the inlet mixer 2 into the tub 4; however, one or more of these flows can be initially directly into the tub 4. Of primary significance to the present invention is that these flows are separately and directly input to the mixing unit 1. Preferably, each of these flows comes from a respective source of the material at the oil or gas well.

One or more pumps (not shown in FIG. 1) move completed slurry from the tub 4 into an oil or gas well or elsewhere (e.g., a holding tank) in a known manner.

The inlet mixer 2 includes one or more suitable devices known in the oil and gas industry for obtaining at least some mixing of the substances prior to entering the tub 4. An example of a suitable mixer is any device designed to combine at high energy levels a number of flow streams of liquid or dry substances into a homogeneous mixture. Specific examples are an eductor; an axial flow mixer disclosed in U.S. Pat. No. 5,046,855 to Allen et al. issued Sep. 10, 1991, assigned to the assignee of the present invention and incorporated herein by reference; and a version of such axial flow mixer modified so that it can directly receive more than two inlet flows as well as the circulation or recirculation flow disclosed in the aforementioned patent.

The tub 4 also includes one or more suitable devices known in the oil and gas industry for receiving inlet flows of substances and for mixing the substances into an averaged slurry. Such a tub 4 can include one or more tanks, multiple compartments within a tank, and one or more circulation or recirculation lines. Examples of suitable tubs include 8-barrel single or double compartment tubs and 25-barrel double and triple compartment tubs. A tub providing for the most mixing energy is typically preferred.

The substances to be flowed into the mixing unit 1 (specifically through the mixer 2 into the tub 4 in the FIG. 1 embodiment) include both the previously defined "essential materials" and the previously defined "additives". That is, the process of the present invention can be implemented by flowing all the ingredients of a slurry recipe directly into the mixing unit 1; however, the present invention is most broadly defined as comprising flowing at least three separate streams of different essential materials directly into the mixing unit 1 at the oil or gas well, wherein each of the essential materials is required to obtain a predetermined defining characteristic of the slurry. Within this broader context, additives and other essential materials can also be flowed directly into the mixing unit, or one or more of any such additives and other essential materials can be added to one or more of the at least three separate streams upstream or downstream of the mixing unit 1.

Referring to the terminology used in FIG. 1, essential materials include "dry materials" 6*a*, 6*b*, etc. and "fluids" 10*a*, 10*b*, etc. Although essential materials are defined based on their criticality to obtaining a defining characteristic of a slurry, the dry materials and/or fluids which are the essential materials of a particular slurry also typically contribute to a large percentage of the overall slurry throughput rate.

The slurry characteristic modifying or enhancing "additives" typically contribute to a small percentage of the throughput rate. Referring to FIG. 1, these substances include "dry additives" 8*a*, 8*b*, etc. and "liquid additives" 12*a*, 12*b*, etc.

Essential dry materials for a cement slurry defined by its density include at least one cementitious substance (e.g., cement) and at least one density control agent (e.g., fly ash). Essential dry materials for a settable mud defined by its recipe include at least one cementitious substance (e.g., blast furnace slag, cement, fly ash). Essential dry materials for a drilling fluid defined by its density include at least one viscosity control agent (e.g., bentonite) and at least one density control agent (e.g., barite).

Essential fluids typically include at least one liquid, such as fresh water, seawater, brine and liquid hydrocarbons. One or more of these can be used as a dilution fluid for a settable mud or as a fluid medium for a drilling fluid. A drilling fluid is typically an essential fluid for a settable mud. Fresh water, seawater and brine are examples of a hydrating fluid that is typically an essential material for the defining characteristic of cement slurry density.

Examples of dry additives include ones used for fluid loss, dispersants, retarders, accelerators, activators and extenders. Particular additives are caustic soda beads, soda ash and Spersene. Examples of liquid additives include ones that serve the same purpose as dry additives, but in liquid form.

The flow rates of each of the components 6, 8, 10, 12 are set by the slurry design. Although the slurry design is typically predetermined in known manner some time before the process is performed, this design can be changed at any time and yet be immediately implemented using the present invention (that is, assuming all the needed substances are at the well site—it is to be noted, however, that only the individual substances need be present; no preblending or batching is necessary because the individual materials and additives can be taken by the present invention and mixed "on-the-fly"). The control of the flow rates, or proportions, of each of these components can be done either in a manual or automatic mode of operation (preferably automatically, as subsequently described). The control of the flow rates is through suitable metering and conveying means as represented in FIG. 1.

Examples of metering and conveying means 14*a*, 14*b*, etc. for the dry materials 6 include screw feeders, belt feeders, eductors, rotary airlocks, pneumatic conveyors (e.g., with control valves and with or without a mass flow meters), single pass flow meters, a cement venturi flow meter currently under development by Halliburton Services Division of Halliburton Company, and a bulk metering device currently under development by Halliburton Services.

Examples of metering and conveying means 16*a*, 16*b*, etc. for the dry additives 8 include the same as above for the means 14, except for pneumatic conveyors and with the addition of semi-bulk mixers.

Examples of metering and conveying means 18*a*, 18*b*, etc. for the fluids 10 include centrifugal pumps, control valves, progressive cavity pumps and gear pumps.

Examples of metering and conveying means 20*a*, 20*b* etc. for the liquid additives 12 include gear pumps, progressive cavity pumps, centrifugal pumps and control valves.

Sensing to provide signals used in controlling the process can be by any suitable means, such as turbine flow meters, magnetic flow meters, pump speed sensors, position detectors and densimeters.

Figure 2:
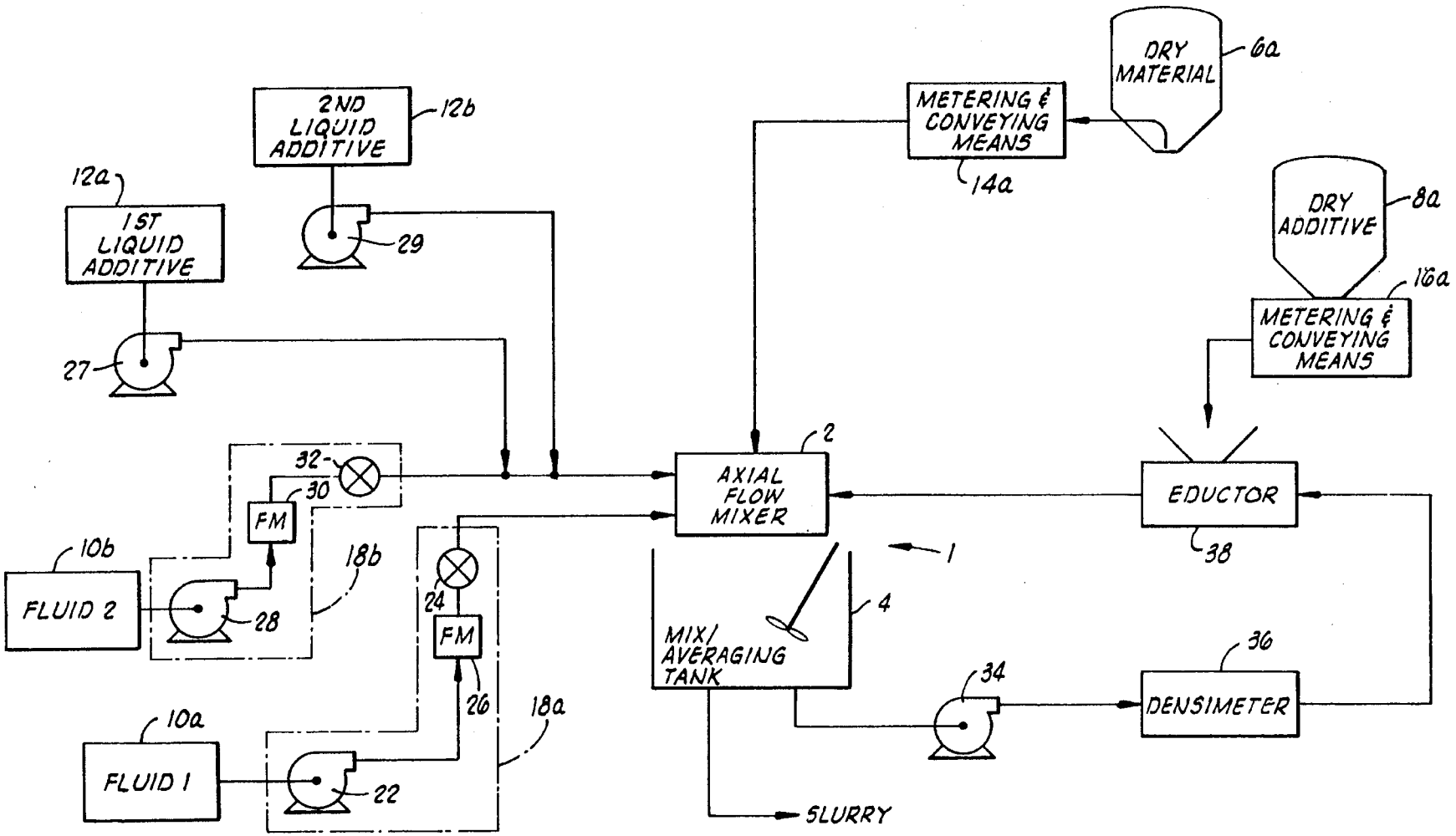
FIG. 2 is a schematic and block diagram of a particular implementation of the general slurrying process.

Referring to FIG. 2, wherein like elements are marked by the same reference numerals as used in FIG. 1, a particular implementation for performing the continuous multi-component cementitious slurrying process of the present invention will be described. This representation illustrates the aspect of the present invention wherein a minimum of three separate essential material streams are flowed directly into the mixing unit 1. An optional, but typically preferred, fourth inlet stream provided by a recirculation loop is also shown.

As shown in FIG. 2, the four streams of differing compositions are continuously flowed into the inlet mixer 2 (specifically a Halliburton Services axial flow mixer modified to receive all four inlet streams) and through the inlet mixer 2 into the averaging tub 4 to define a mixture (i.e., the slurry) in the tub 4. This inlet flow occurs without stopping the flow of the streams through the inlet mixer 2. One stream has the dry material 6*a* (e.g., cement or slag is flowed by the metering and conveying means 14*a* into the axial flow mixer 2). Another stream has the fluid 10*a* (e.g., water is pumped into the axial flow mixer 2 under control of a pump 22 and a metering valve 24 of the metering and conveying means 18*a* which also includes a flow meter 26). Still another stream has another essential material (in FIG. 2, this stream includes a mixture of the second essential fluid 10*b*, such as drilling fluid, and two liquid additives 12*a*, 12*b*, such as a dispersant and an activator; the additives are pumped by respective metering pumps 27, 29 of the metering and conveying means 20*a*, 20*b*, respectively, into the fluid 10*b* that is pumped by a pump 28 through a flow meter 30 and a control valve 32 defining the metering and conveying means 18*b*; this mixture is pumped into the axial flow mixer 2). These streams are mixed in the axial flow mixer 2. Continued mixing of these streams occurs in a known manner in the tub 4.

In the FIG. 2 implementation, the fourth stream has a portion of the mixture circulating from the tub 4 through the inlet mixer 2 for mixing therein with the three other inlet streams. This circulation or recirculation stream is moved by a conventional pump 34 (e.g., a centrifugal pump), and the density of the stream is monitored by a conventional densimeter 36 (e.g., a radioactive densimeter). The fourth stream flows through a conventional eductor 38 in the FIG. 2 implementation, into which eductor the dry additive 8*a* (e.g., a second activator) is added so that this embodiment includes continuously flowing a further additive into the portion of the mixture circulating from the tub 4 through the inlet mixer 2. More generally, one or more additives can be continuously added into at least one of any of the streams of essential materials.

With the four streams flowing through the axial flow mixer 2 of the FIG. 2 embodiment and into the tub 4 for mixing, a slurried mixture is obtained in the tub 4. At least a portion of this mixture is pumped from the tub 4 in a conventional manner. Once an initial volume of the slurry has been produced in the tub 4, this pumping can occur simultaneously with the continuous inlet flowing and mixing steps described above.

Figure 3:
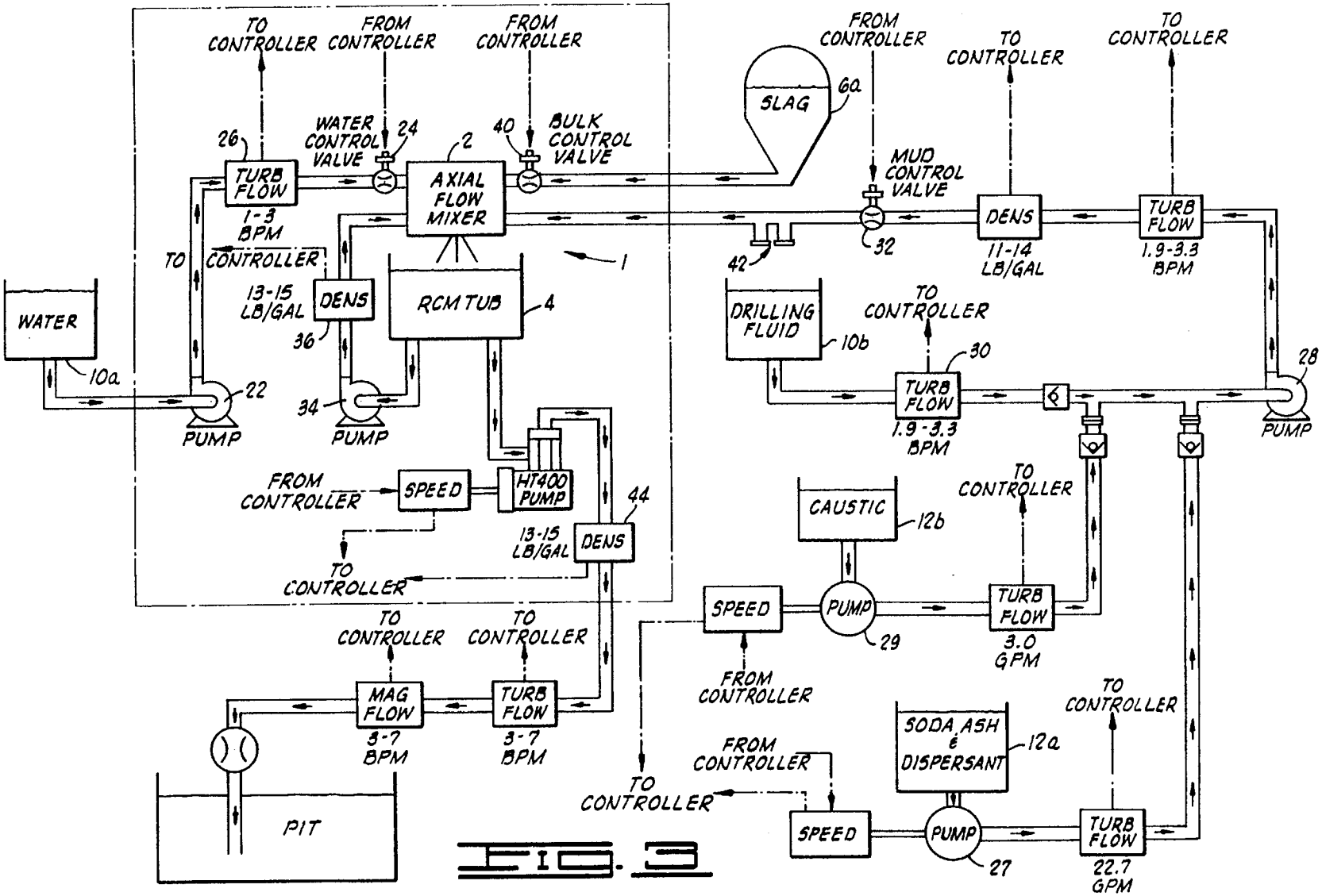
FIG. 3 is a schematic and block diagram of a test system used for testing the process of the present invention.

A schematic of a test setup by which the continuous multi-component slurrying process has been successfully tested is shown in FIG. 3 (parts corresponding to those in FIGS. 1 and 2 are identified by like reference numerals). In this case there were three primary streams of essential materials: essential dilution fluid and drilling fluid streams (water 10*a* and drilling fluid 10*b* respectively) and an essential cementitious substance flow stream (blast furnace slag 6*a*). Two liquid additives 12*a*, 12*b* (soda ash/dispersant mixture and caustic solution, respectively) were added to the drilling fluid stream. No dry additives were used. The proper proportions for combining the components were determined from a predetermined slurry design. The dry cementitious substance flow stream was controlled using a bulk control valve 40 of the metering and conveying means 14*a*. The valve 40 was controlled in response to the slurry density feedback measured in the recirculation loop by the densimeter 36. The two fluid flow stream rates were controlled using separate control valves 24, 32 and flow rate feedback from each flow stream was provided by turbine flow meters 26, 30, respectively. The liquid additives 12*a*, 12*b* were injected into the drilling fluid flow stream using metering pumps 27, 29, respectively. Upon flowing the three streams of essential materials, with the additives included in the drilling fluid inlet flow, directly into the mixing unit 1, the additives and essential materials were fully mixed.

The test showed that for the particular slurry design the components could be successfully combined using a continuous process. The slurry had excellent mixing and pumping properties both in the pumps and in the manifolding. Laboratory tests of the slurry compared favorably with pilot samples of the slurry mixed in the lab. Thus, it was concluded that the slurry properties were not affected by the process. The following describes the test in more detail.

The system that was tested specifically comprised an SKD4 cementing skid with an 8 barrel mix tub 4 and Halliburton Services automatic density control with the following additional equipment: drilling fluid pump 28—Deming 5M centrifugal; drilling fluid control valve 32—pneumatically actuated 3-inch butterfly valve; drilling fluid line connection in the mixer 2 and an alternate connection in the primary mix tub 4; the two liquid additive pumps 27, 29; hydraulic power pack for driving the pumps; and two liquid additive tanks.

The liquid additives used were a 50% caustic solution and a 25% soda ash solution with Spersene dispersant in it. A 14 pound per gallon (lb/gal) lignosulfonate drilling fluid from M-I in Lafayette, La. was used for the tests. The slurry design called for a dilution ratio of 50% water and 50% original drilling fluid and a density of 14.4 lb/gal. The material quantities used in the formulation of the slurry are listed in Table 1.

TABLE 1

SLURRY FORMULATION

| | | |
|---|---|---|
| Materials required for one barrel of dilute mud: | | |
| Bulk Material | | 300 lb. |
| Caustic Soda | | 5 lb. |
| Soda Ash | | 15 lb. |
| Spersene | | 2.5 lb. |
| One barrel of mixed slurry required: | | |
| Original Drilling Fluid | | 16.0 gal. |
| Water | | 11.5 gal. |
| Bulk Material | | 229.2 lb. |
| 50% Caustic Solution | | 0.6 gal. |
| 25% Soda Ash Solution | | 4.4 gal. |
| Spersene | | 1.9 lb. |
| For a 5 bbl/min mix rate: | | |
| Original Drilling Fluid | 80.2 gal/min, | 1.9 bbl/min |
| Water | 57.3 gal/min, | 1.4 bbl/min |
| Bulk Material | 1,145.8 lb/min, | 13.5 sks/min |
| 50% Caustic Solution | 3.0 gal/min | |
| 25% Soda Ash/ Spersene Solution | 22.1 gal/min | |

Although the additives used in the test can be mixed as shown in FIG. 3, it is preferred to have all of the liquid additives separate to avoid adverse reactions occurring. For example, it was discovered that when the caustic and soda ash were combined in solution, a precipitate was formed. When the Spersene dispersant was added to the 50% caustic solution, it gelled into an unpumpable mixture.

Three separate test runs were made, all using the same formulation and the same downhole flow rate of 5 barrels per minute (bbl/min). These test runs were:

1. manual control—with the liquid additives injected into the suction of the pump 28 and the drilling fluid line connected to a nozzle installed in the axial flow mixer 2.
2. automatic density control—with the liquid additives injected into the pump discharge line downstream of the control valve 32 (see inlets 42 in FIG. 3) and with the drilling fluid line discharging into the mix tub 4.
3. Repeat of run 2.

Table 1 above shows the flow rates for each of the materials based on a slurry density of 14.4 lb/gal and a downhole flow rate of 5 bbl/min.

Figure 4:
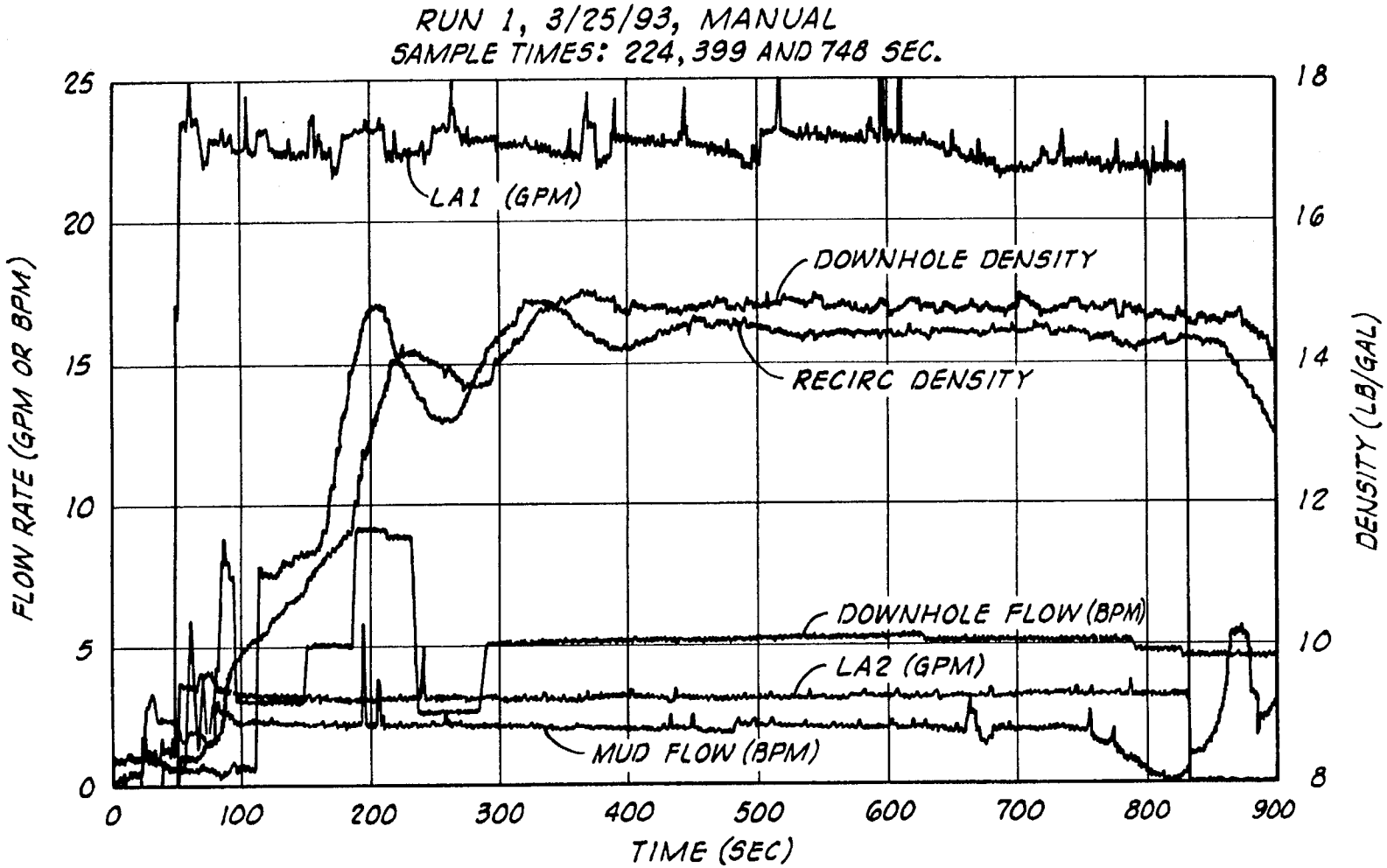
FIG. 4 is a flow rate versus time graph showing sensed conditions of a first test using the system of FIG. 3.

The first test run was completed with no problems. The slurry was mixed at the correct density according to the recirculation densimeter 36, but it turned out to be about 0.4 lb/gal heavy through most of the run. A downhole densimeter 44 gave a more accurate reading. In this run, the liquid additives were injected just ahead of the pump 28 suction. To start the mixing process, the drilling fluid **10*b* flow was started first, followed by the liquid additives 12*a*, 12*b*, and finally the bulk material 6*a* and water 10*a*. When the liquid additive flows were started, a viscosity increase in the tub was noticed; however, the slurry was in excellent, pumpable condition. A plot of the mixing parameters is shown in FIG. 4**.

Figure 5:
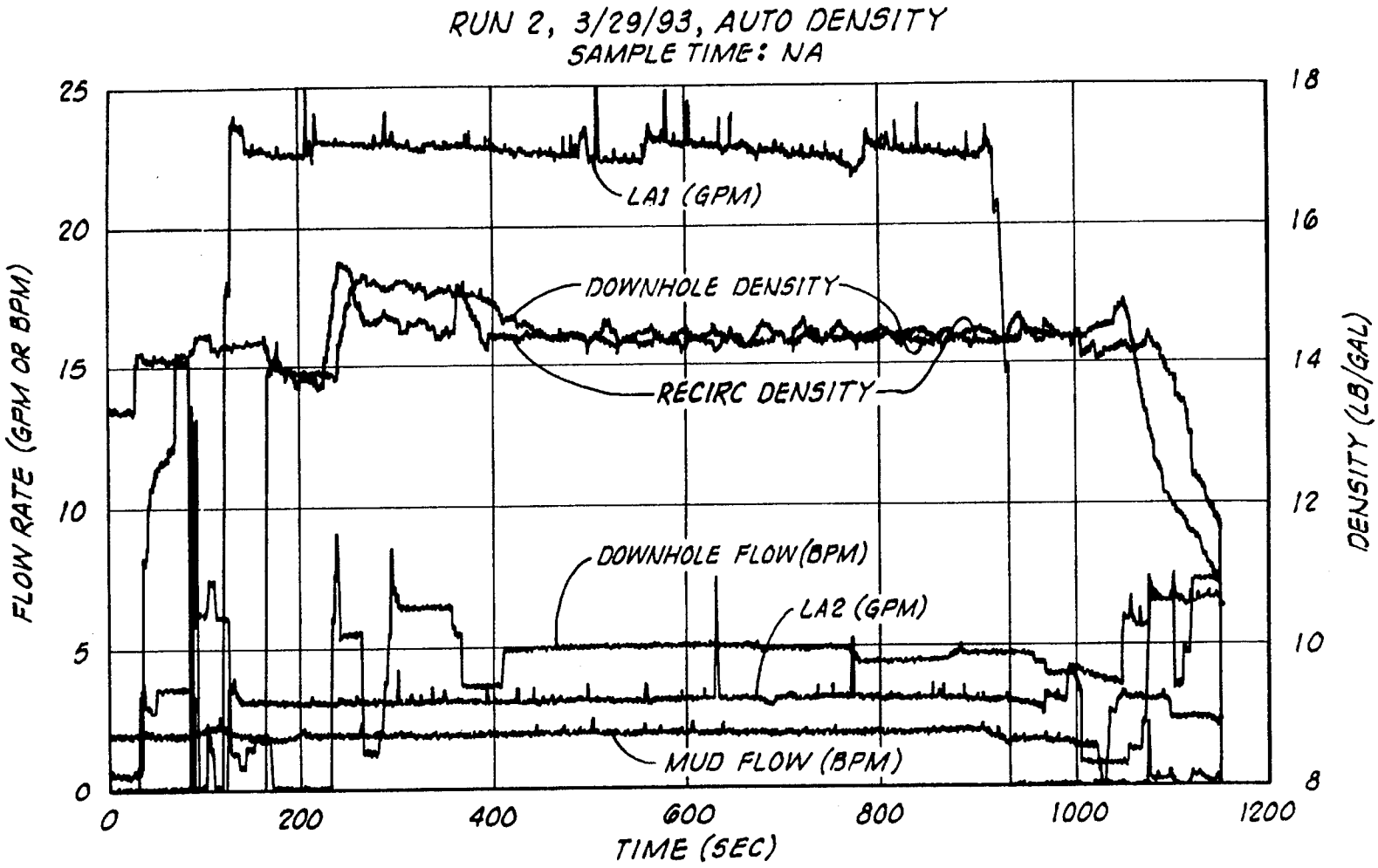
FIG. 5 is a flow rate versus time graph showing sensed conditions of a second test using the system of FIG. 3.

The objective of the second test run was to try the existing Halliburton Services automatic density control system (ADC) and also to use the alternate injection points for the liquid additives and drilling fluid. In this case, the liquid additives **12*a*, 12*b* were injected at inlets 42 in the pump discharge downstream of the control valve 32 and the drilling fluid was pumped directly into the primary mix tub 4 bypassing the inlet mixer 2. At the start of this run the densimeter 36 was miscalibrated and ended up mixing the slurry at about 13.4 lb/gal. The existing Halliburton Services automatic density control was used in this case and the density was maintained within a tenth of a lb/gal throughout the run. This low density corresponds to a bulk material concentration of about 180 lb/bbl of original mud. Since the slurry density was so low, no samples were tested in the lab. This run is plotted in FIG. 5**.

Figure 6:
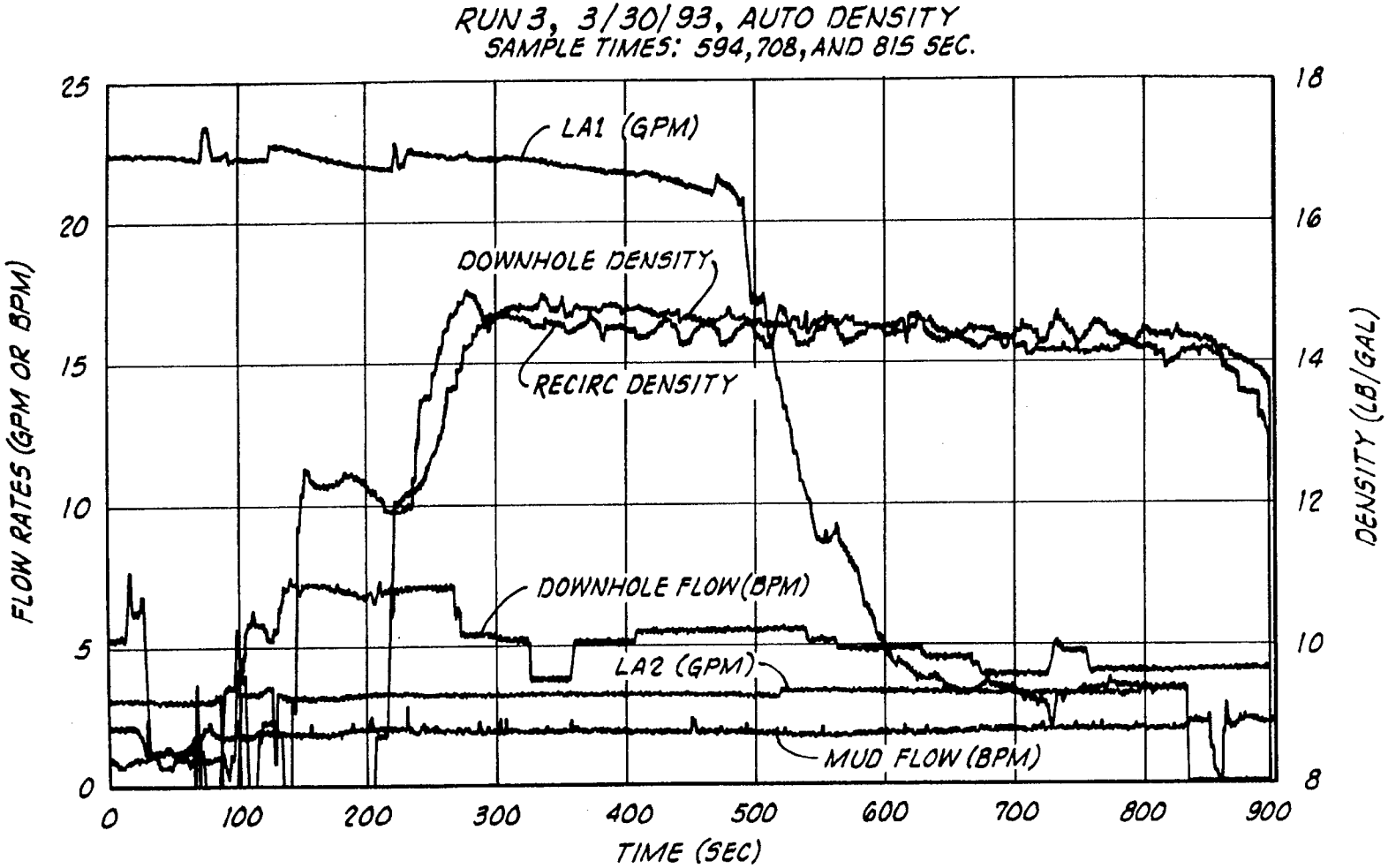
FIG. 6 is a flow rate versus time graph showing sensed conditions of a third test using the system of FIG. 3.

The third test run was a repeat of the second run except mixing occurred at the correct density. Toward the end of this run, the strainer in the soda ash liquid additive pump 27 got clogged with rust and the soda ash flow rate dropped to about 3 gallons per minute (gal/min). Thus, of the three samples that were caught and tested, only the first one had even close to the correct amount of soda ash and Spersene dispersant. Note that in this run and in run 2, there was not as severe a viscosity kick as had been seen in run 1. FIG. 6 is a plot of the mixing parameters for this third run.

Figure 7:
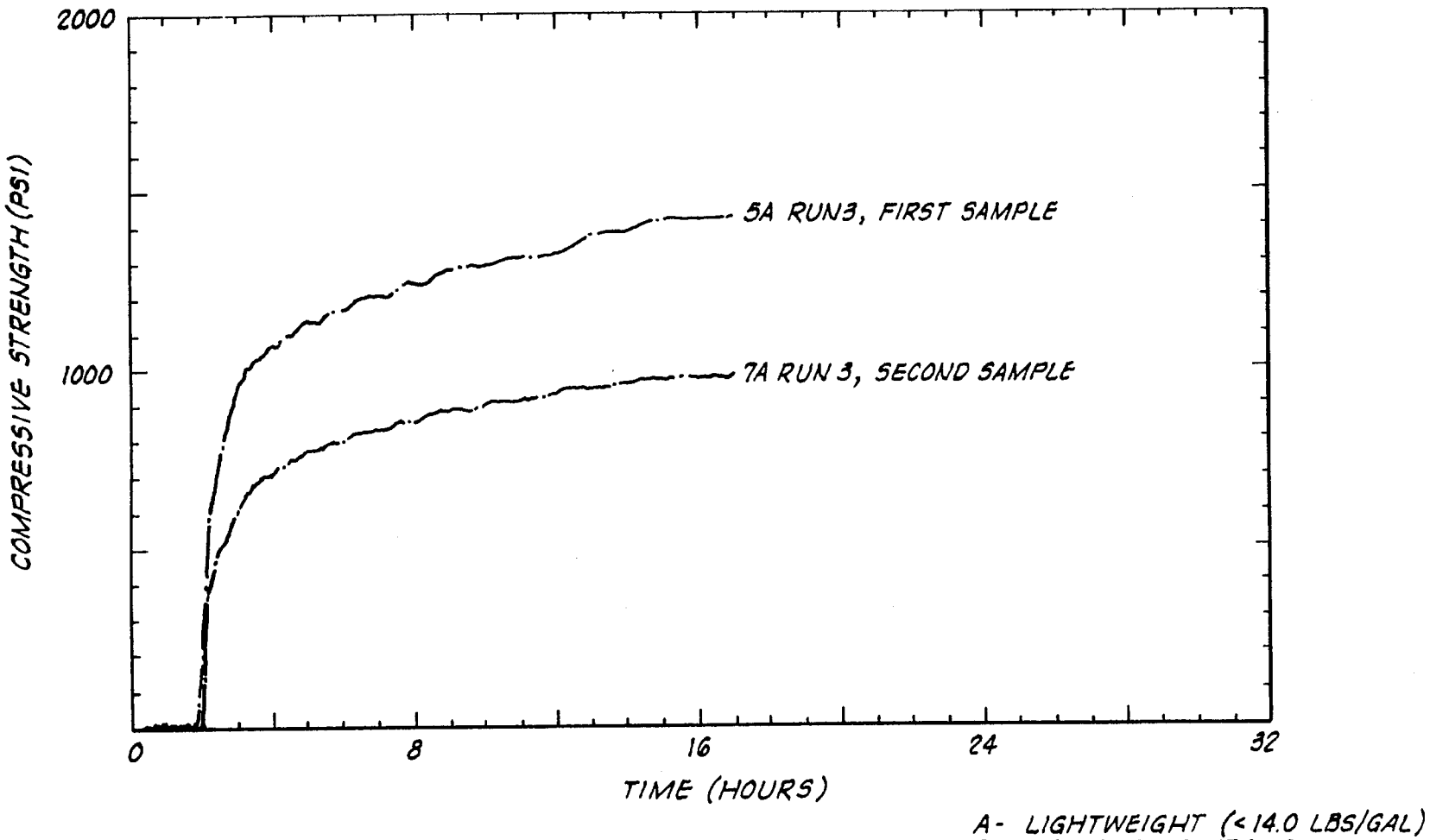
FIG. 7 is a graph of compressive strength versus time for samples from the third test.

The lab test results for the slurries mixed in each of the test runs are compared to the pilot tests in Table 2. Notice that in each of FIGS. 4 and 6 the sample times are listed in the title block. For example, the last two samples taken in run 3 (FIG. 6) had very little soda ash and yet they still set and developed some compressive strength. As a point of interest, FIG. 7 shows a strength development plot taken from the Halliburton Services UCA cement analyzer for two of the samples.

TABLE 2

| | Density (ppg) | Thickening Time[1] (hrs:min) | Laboratory Test Results: Compressive Strength[2] UCA, 24 hr (psi) | Initial Set (hrs:min) | Fluid Loss (cc/30 min) | Plastic Viscosity (cp) | Yield Point (lb/100 ft$^2$) |
|---|---|---|---|---|---|---|---|
| PILOT TESTS | 14.4 | 4:33 | 1870 | 3:24 | 183 | 29 | 9 |
| RUN #1 | | | | | | | |
| FIRST | 14.27 | 4:08 | 1175 | 2:14 | 190 | 29 | 18 |
| MIDDLE | 14.86 | 2:58 | 1605 | 3:11 | 153 | 49 | 18 |
| FINAL | 14.87 | 2:35 | 1440 | 3:00 | 164 | 40 | 23 |
| RUN #2 | | | | | | | |
| FIRST | 13.75 | 4:20 | | | | 19 | 18 |
| MIDDLE | 13.40 | | | | | 20 | 17 |
| FINAL | 13.40 | | | | | 18 | 21 |
| RUN #3 | | | | | | | |
| FIRST | 14.78 | 3:03 | 1568 | 1:59 | 160 | 32 | 26 |
| MIDDLE | 14.45 | 3:32 | 1041 | 1:55 | 150 | 29 | 20 |
| FINAL | 14.40 | 2:37 | 800 | 1:48 | 148 | 28 | 24 |

[1]Thickening times using API Spec 10 Schedule 5 g @ 125° F.
[2]UCA Compressive Strength @ 200° F.

The foregoing gives particular examples of the process for continuously mixing a settable mud at an oil or gas well. This can be readily adapted for continuously mixing a cement slurry or a drilling fluid, but using instead the respective essential materials (and any desired additives) for those particular mixtures. As to mixing a drilling fluid, for example, such a method includes: flowing a fluid medium into the mixing unit 1; flowing a viscosity control agent into the mixing unit 1; flowing a density control agent into the mixing unit 1; and mixing the fluid medium, the viscosity control agent and the density control agent in the mixing unit 1 into a drilling fluid. Such a drilling fluid is ultimately to be pumped into the well so that the process further comprises pumping the drilling fluid into the well and returning at least a portion of the drilling fluid from the well and flowing the returned portion into a storage facility; these steps of pumping, returning and flowing the returned portion can be performed in known, conventional manner.

It is contemplated that both the process for the drilling fluid and the process for the settable mud can be sequentially performed so that the thus created drilling fluid can subsequently be used in making the settable mud. That is, at least a portion of the drilling fluid can be taken from the storage facility and flowed as an essential material in the process for making the settable mud. Using at least a portion of the drilling fluid from the storage facility preferably includes conditioning at least a portion of the drilling fluid from the storage facility without substantially increasing the volume of the conditioned portion and pumping the conditioned portion into the mixing unit. Although this conditioning may require a separate holding facility for at least a portion of the drilling fluid from the storage facility, this conditioning does not include treating the portion such that a large volume would be needed or such that a potentially wasted volume of treated fluid would be formed.

From the foregoing, the present invention can be implemented using a prior type of system that provides for first and second streams flowed into a mixing unit of the system, wherein the first stream includes a stream of a first essential material and the second stream includes a stream of premixed substances including at least second and third essential materials (e.g., a blended premix of cement and fly ash for a cement slurry, or a dosed premix of drilling fluid and barite and/or bentonite for a drilling fluid, or a premixed drilling fluid and water for a settable mud). For the present invention, this system is adapted to accommodate three or more inlet flows of essential materials rather than just two. In this context the present invention encompasses the improvement of providing for at least three continuous, properly proportioned flow streams directly into the mixing unit of the system. Providing for this includes: flowing the first essential material directly into the mixing unit; flowing an at least partially unpremixed stream directly into the mixing unit, wherein the at least partially unpremixed stream includes at least ones and only one, of the second and third essential materials; and flowing the other of the second and third essential materials directly into the mixing unit.

Automatic Control Method

Although the continuous multi-component slurrying process can be implemented using manual control as was done in some of the aforementioned tests, it is preferable to use automatic control because it is difficult to manually monitor and control each of the many flows of the process. Any suitable type of control, whether manual or automatic, can be used; however, the preferred embodiment automatic control method operates in the following manner. Examples of specific inputs and outputs for a controller related to the previously described test system are shown by the dot-dash signal lines on FIG. 3.

Figure 8A:
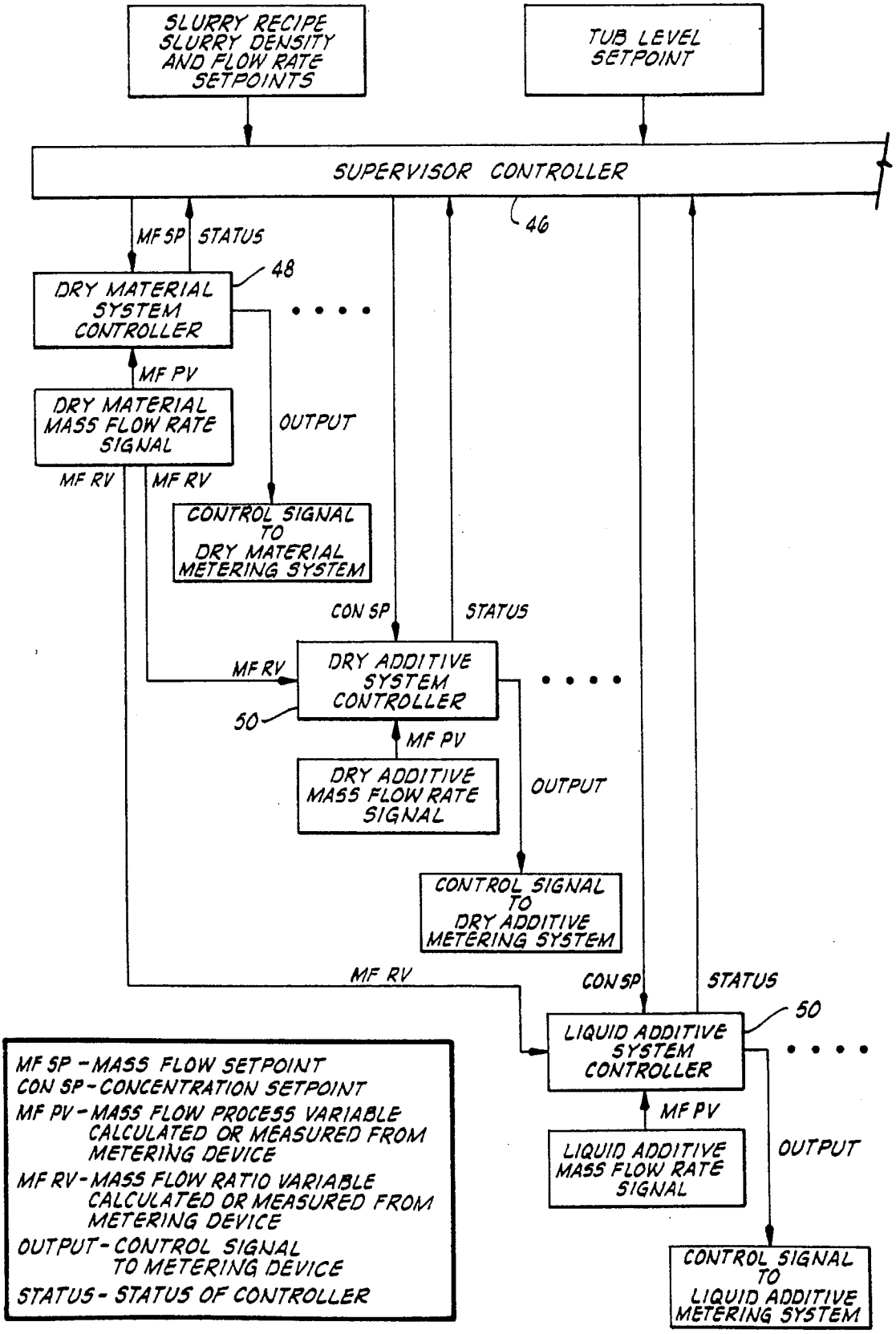
FIGS. 8A and 8B are a flow chart for a control method for automatically controlling the process of the present invention.
Figure 8B:
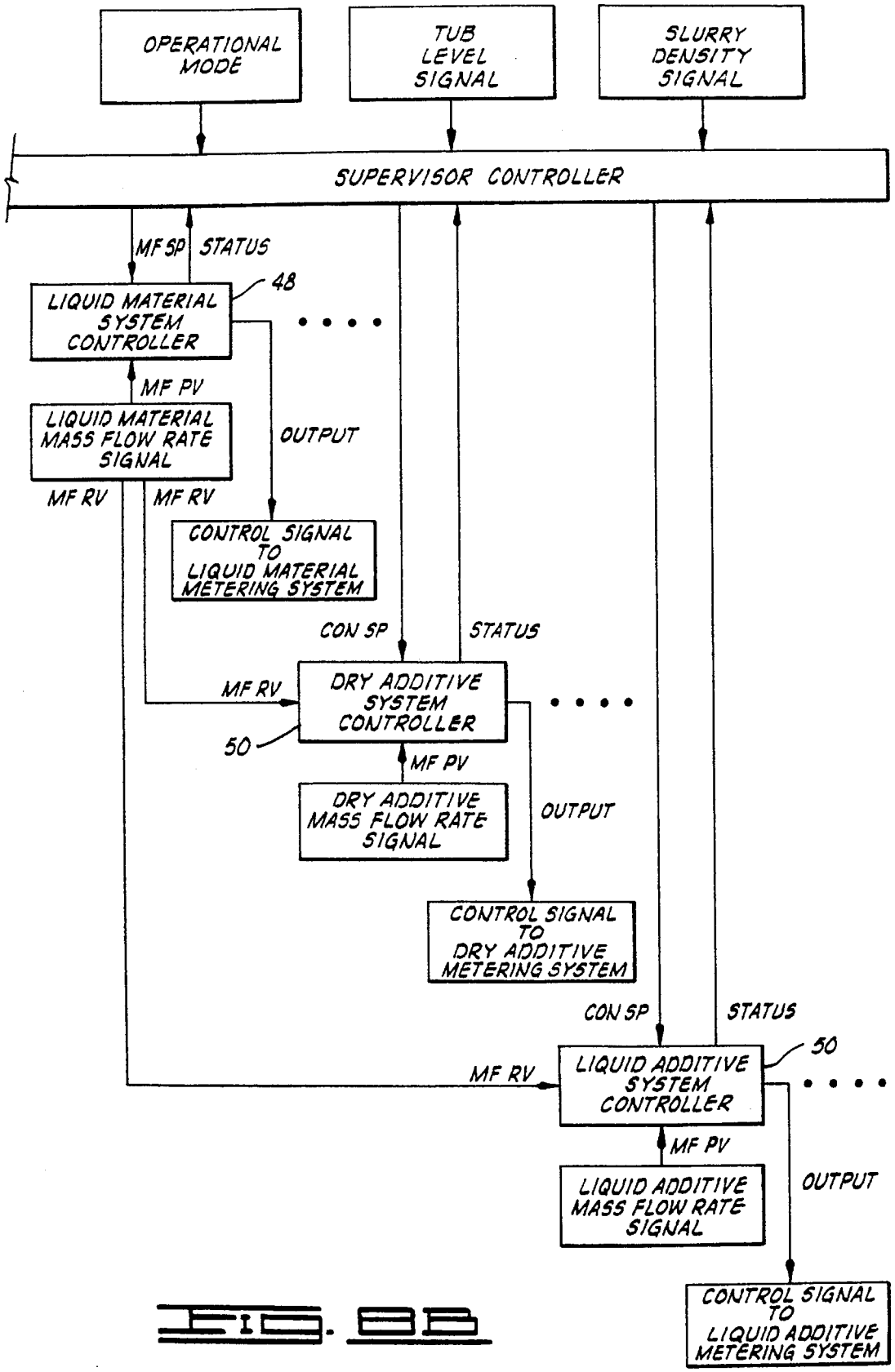
Figure 3A:
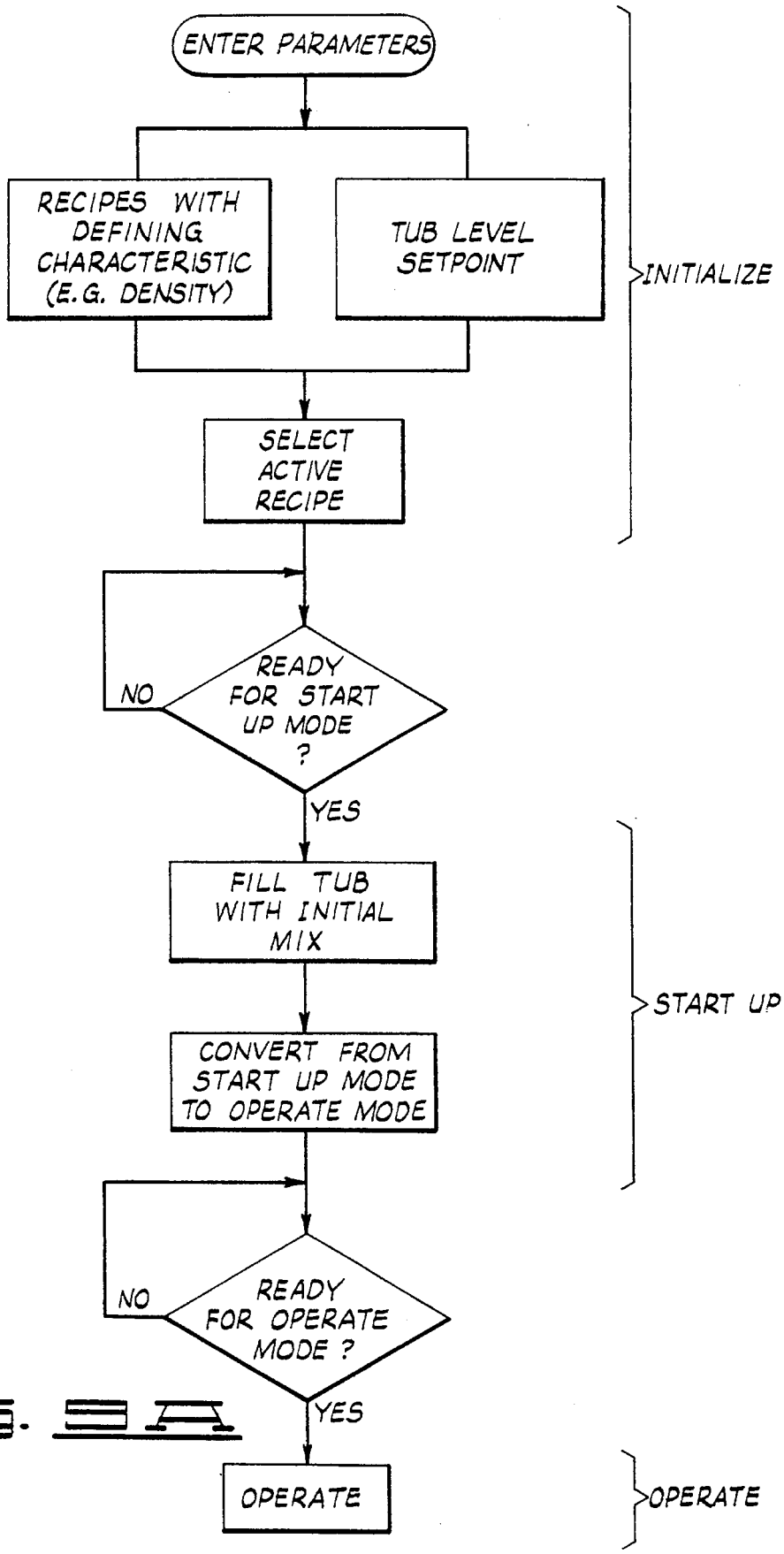
Figure 5B:
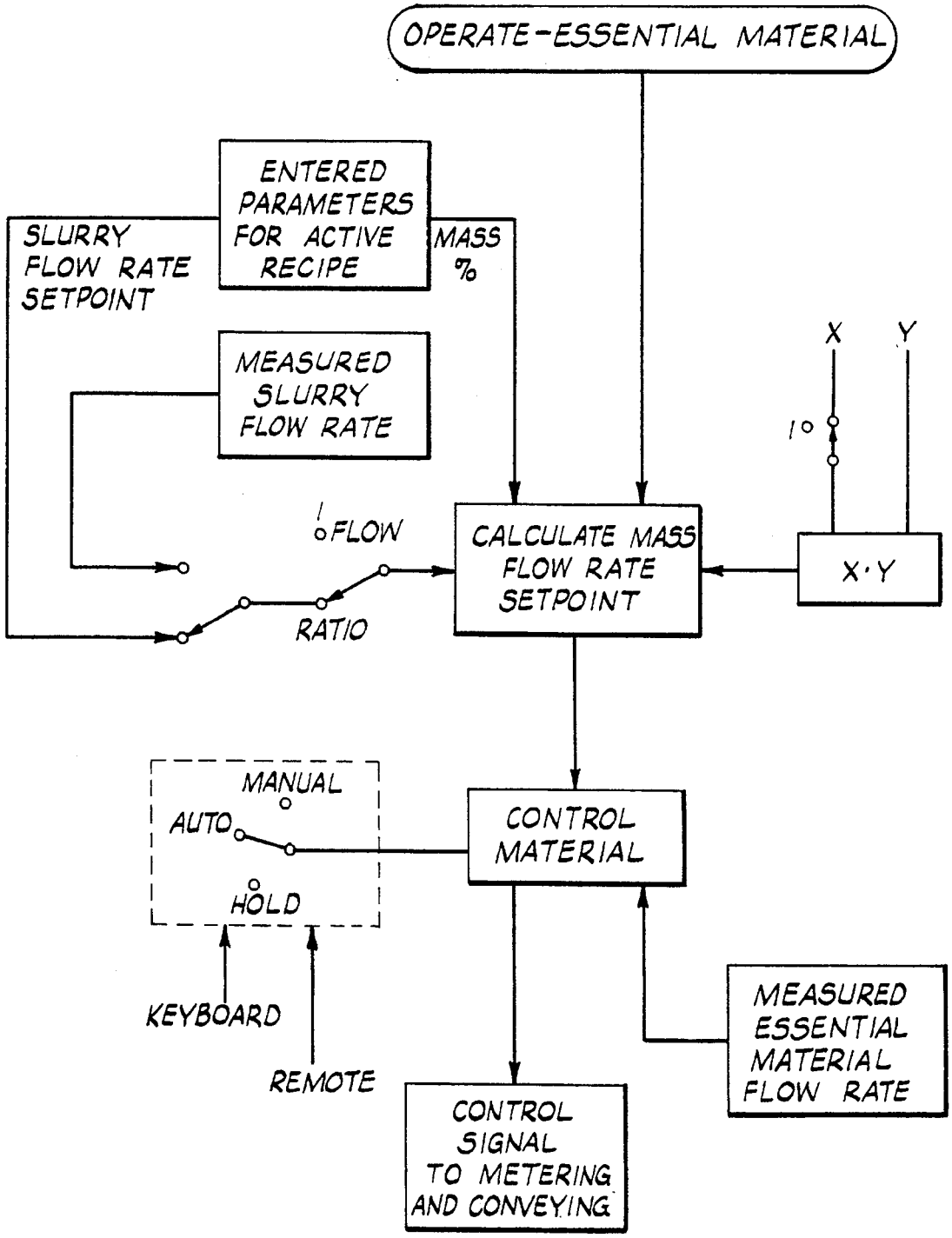
Figure 9C:
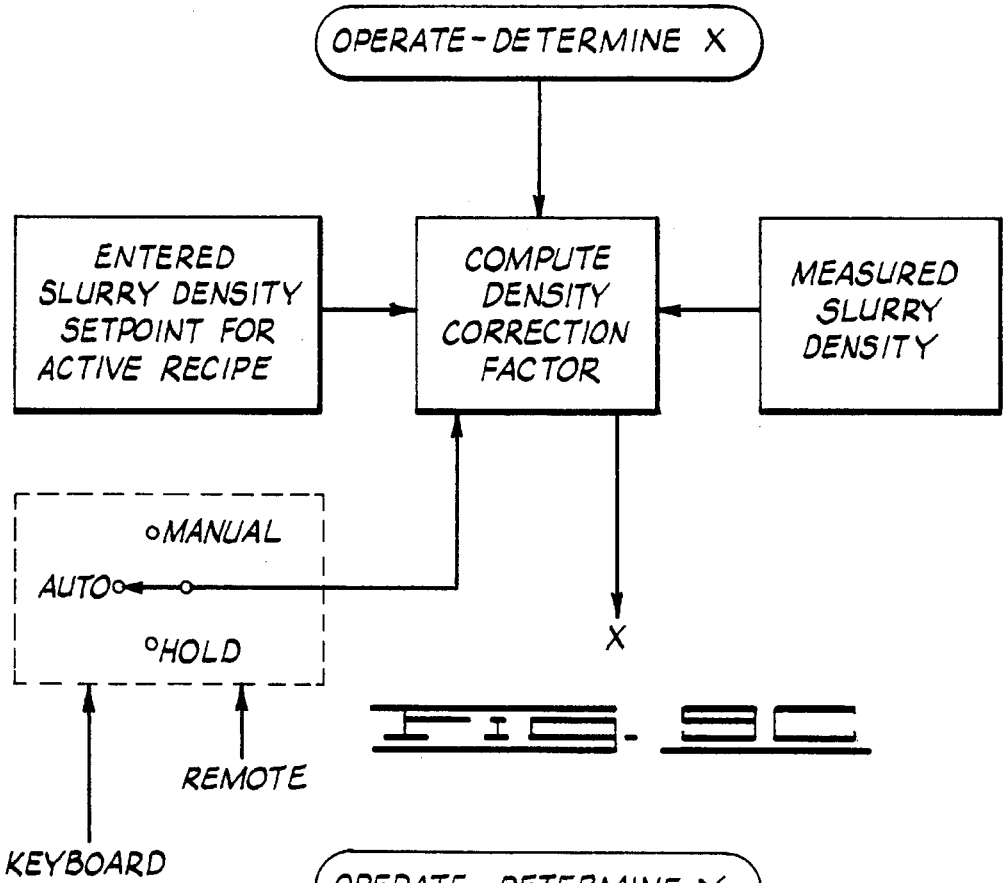
Figure 9D:
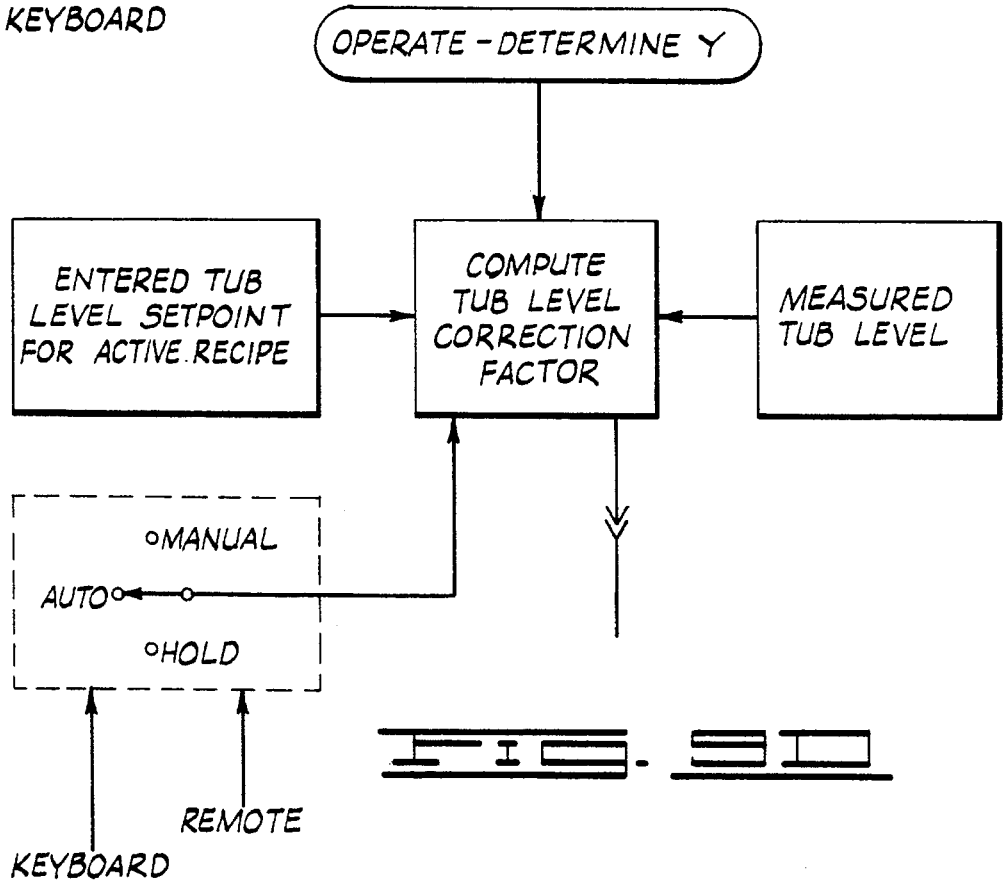
Figure 3E:
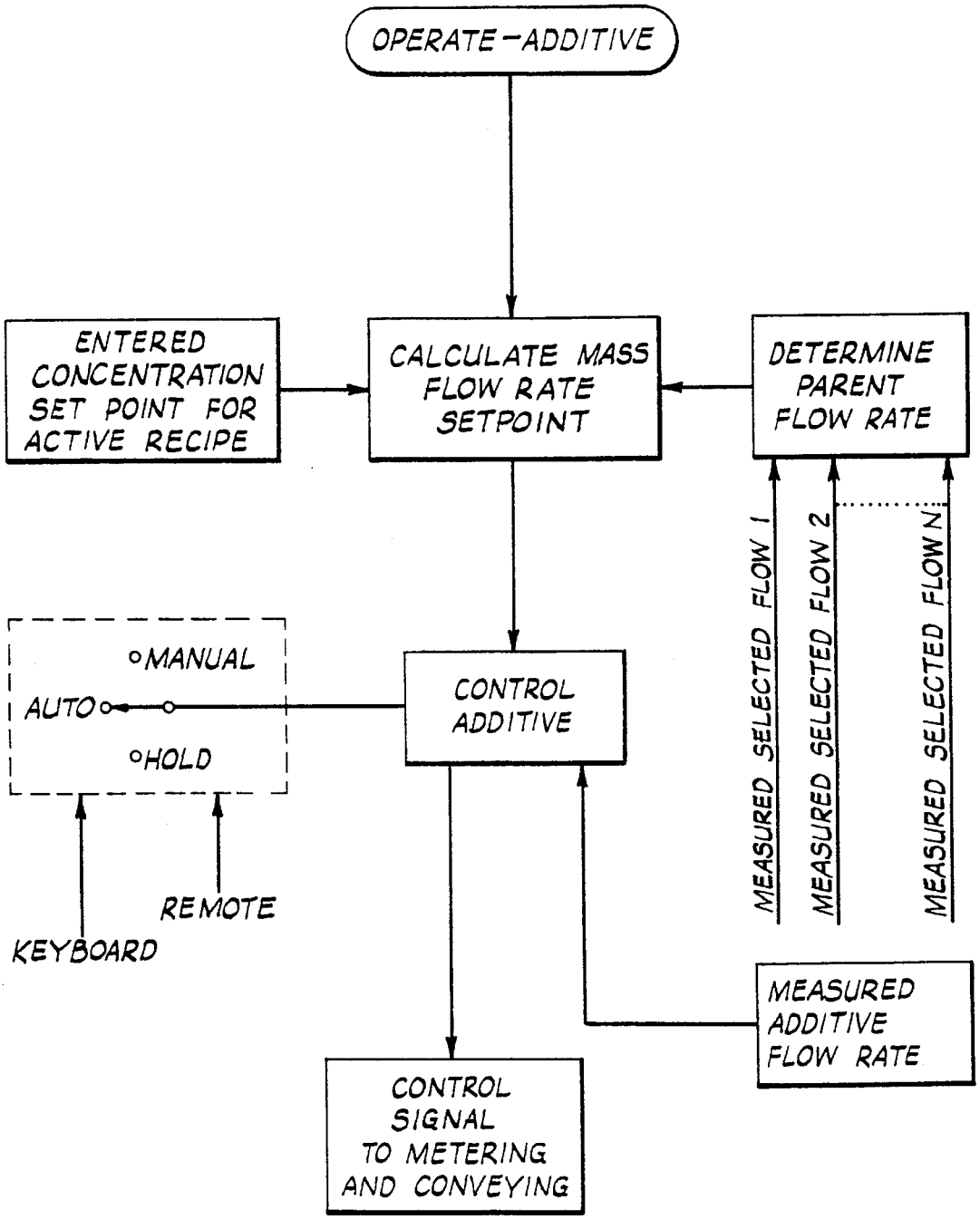
Figure 10A:
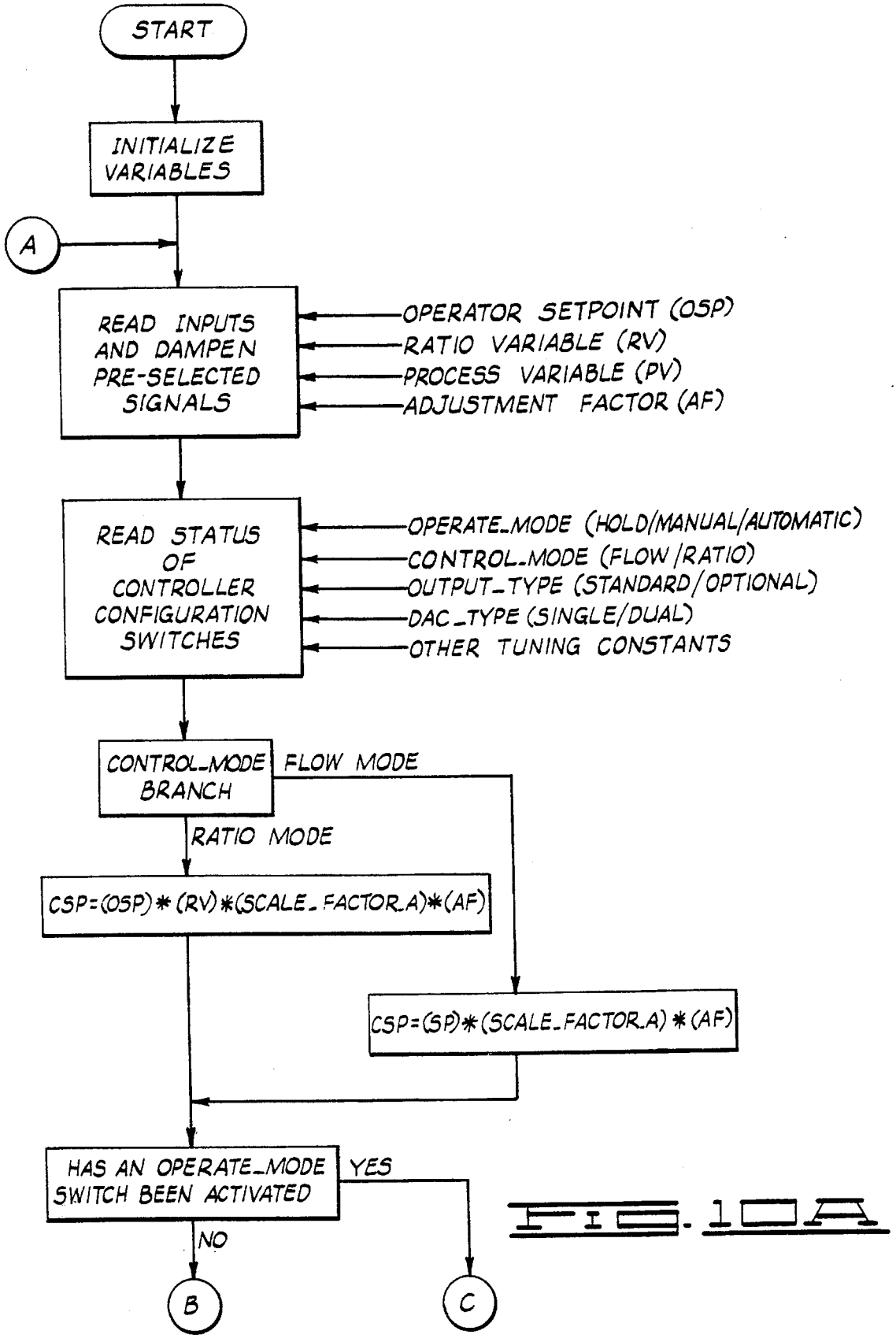
Figure 10B:
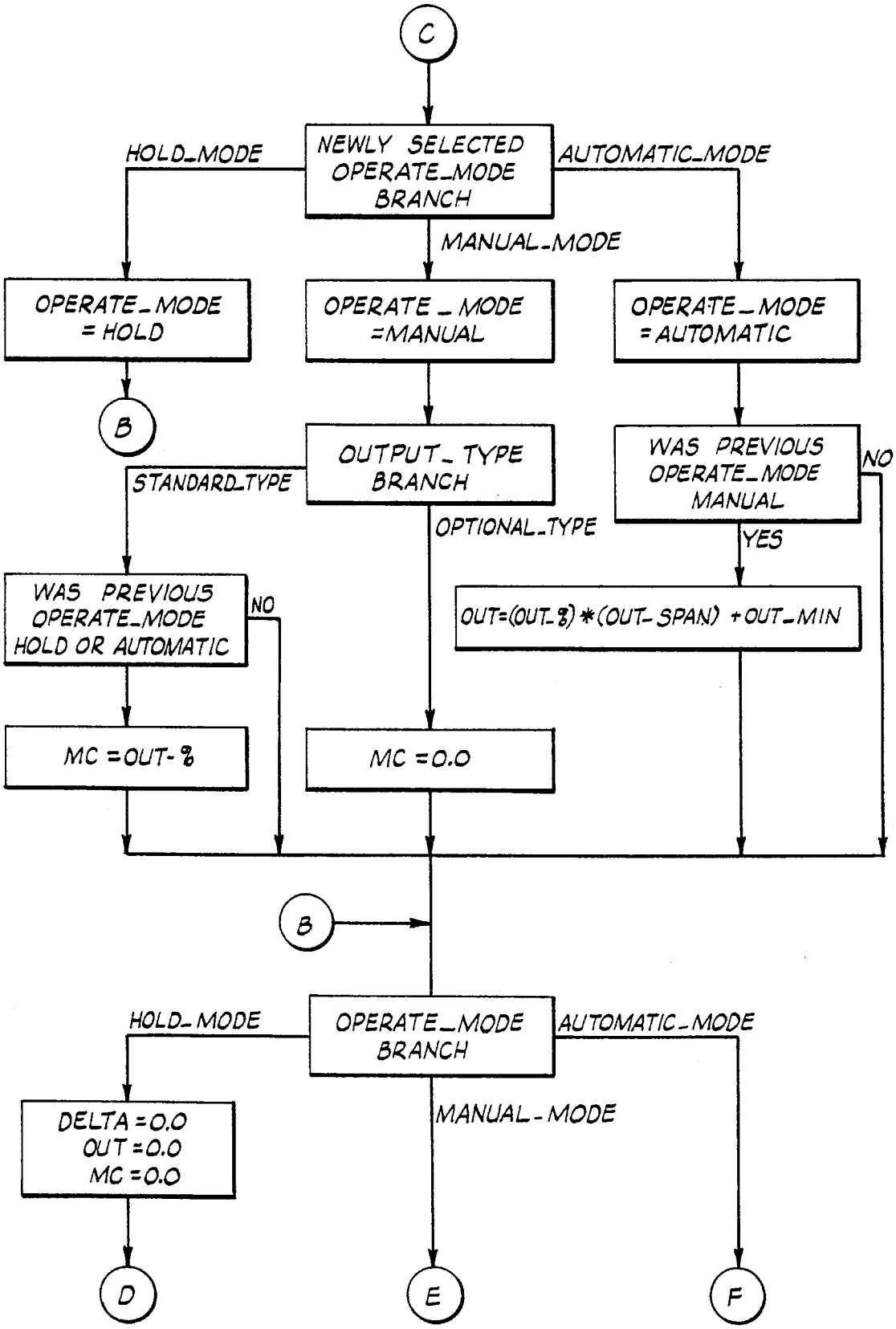
Figure 10C:
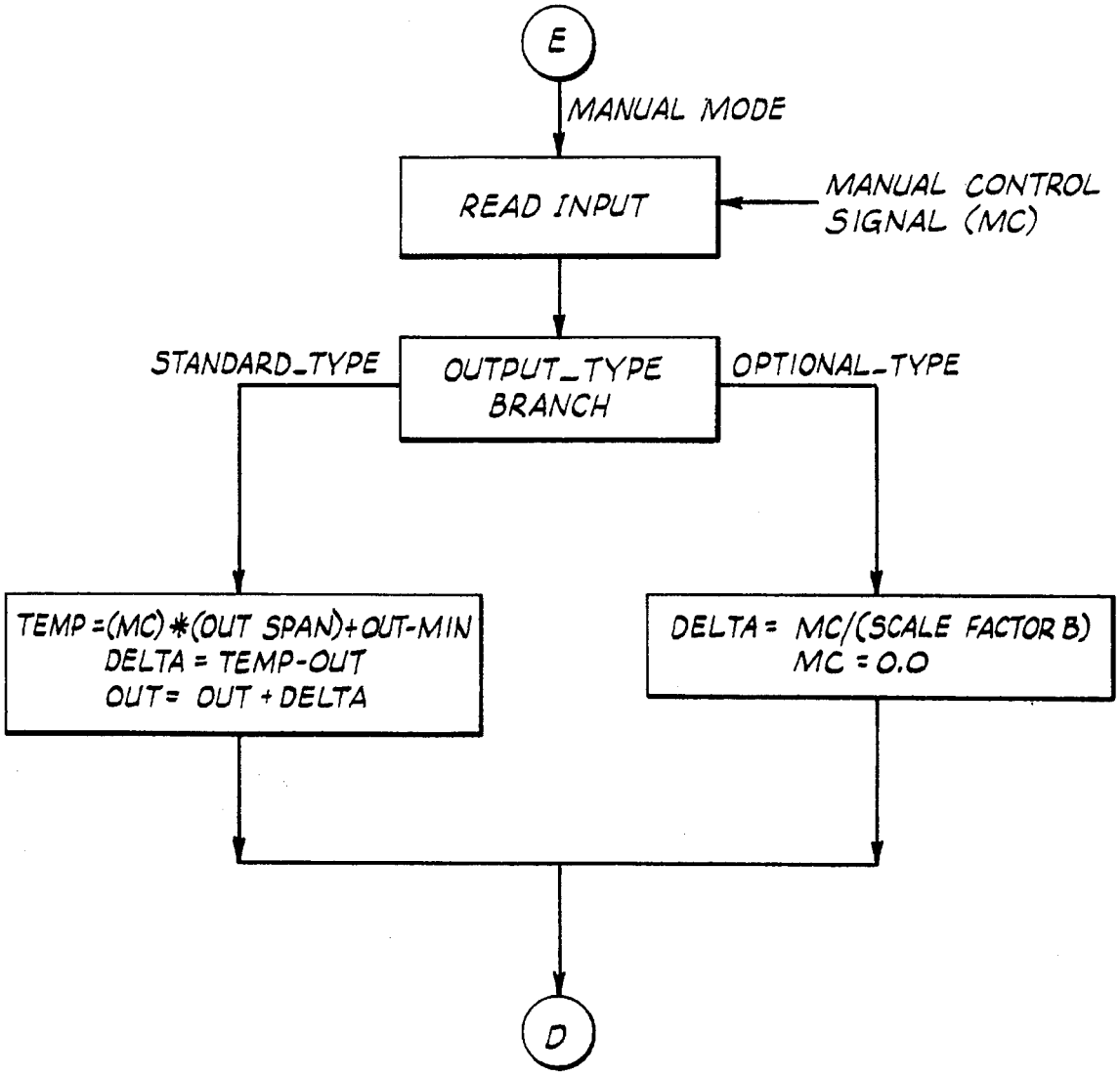
Figure 10D:
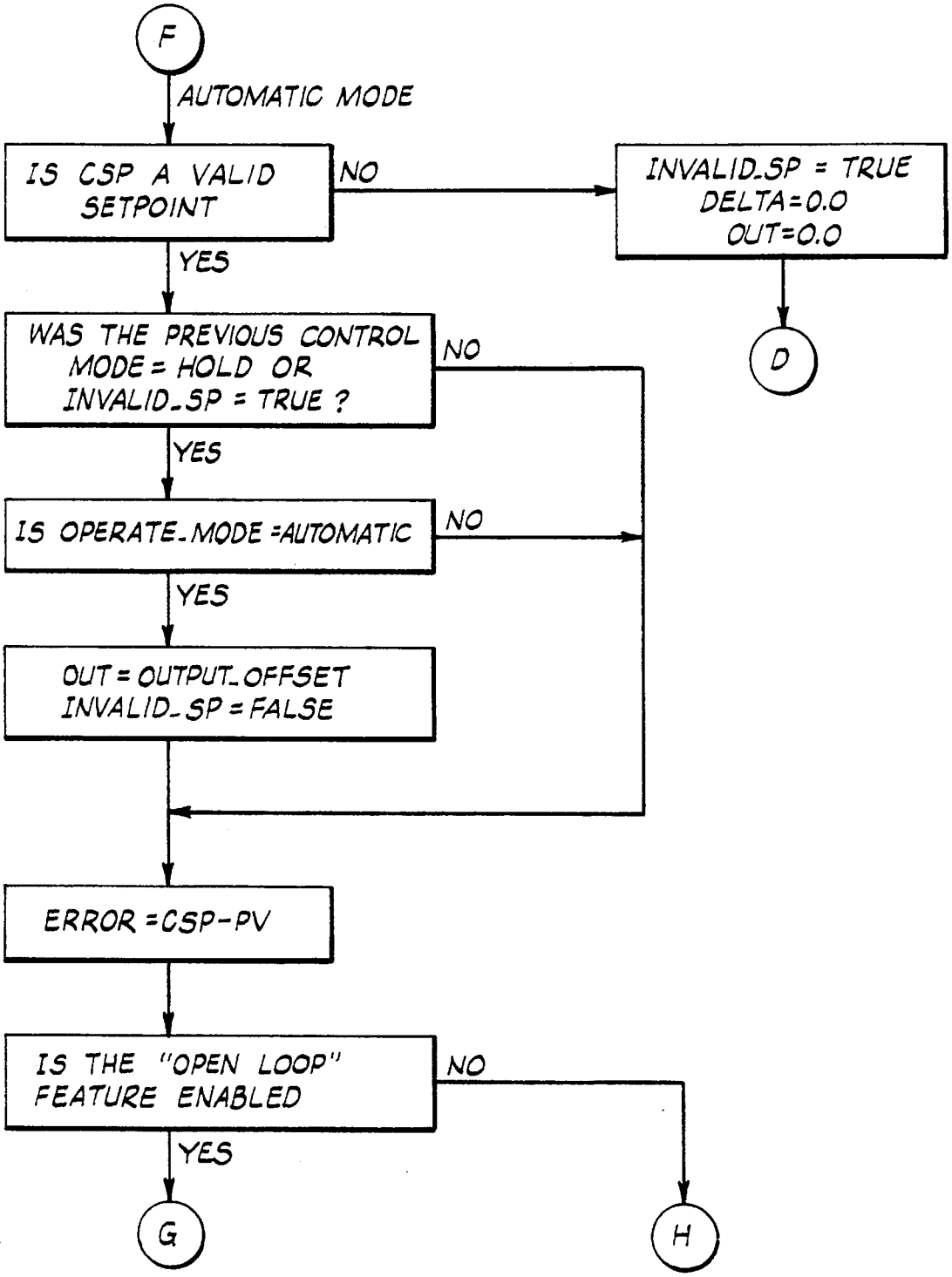
Figure 10E:
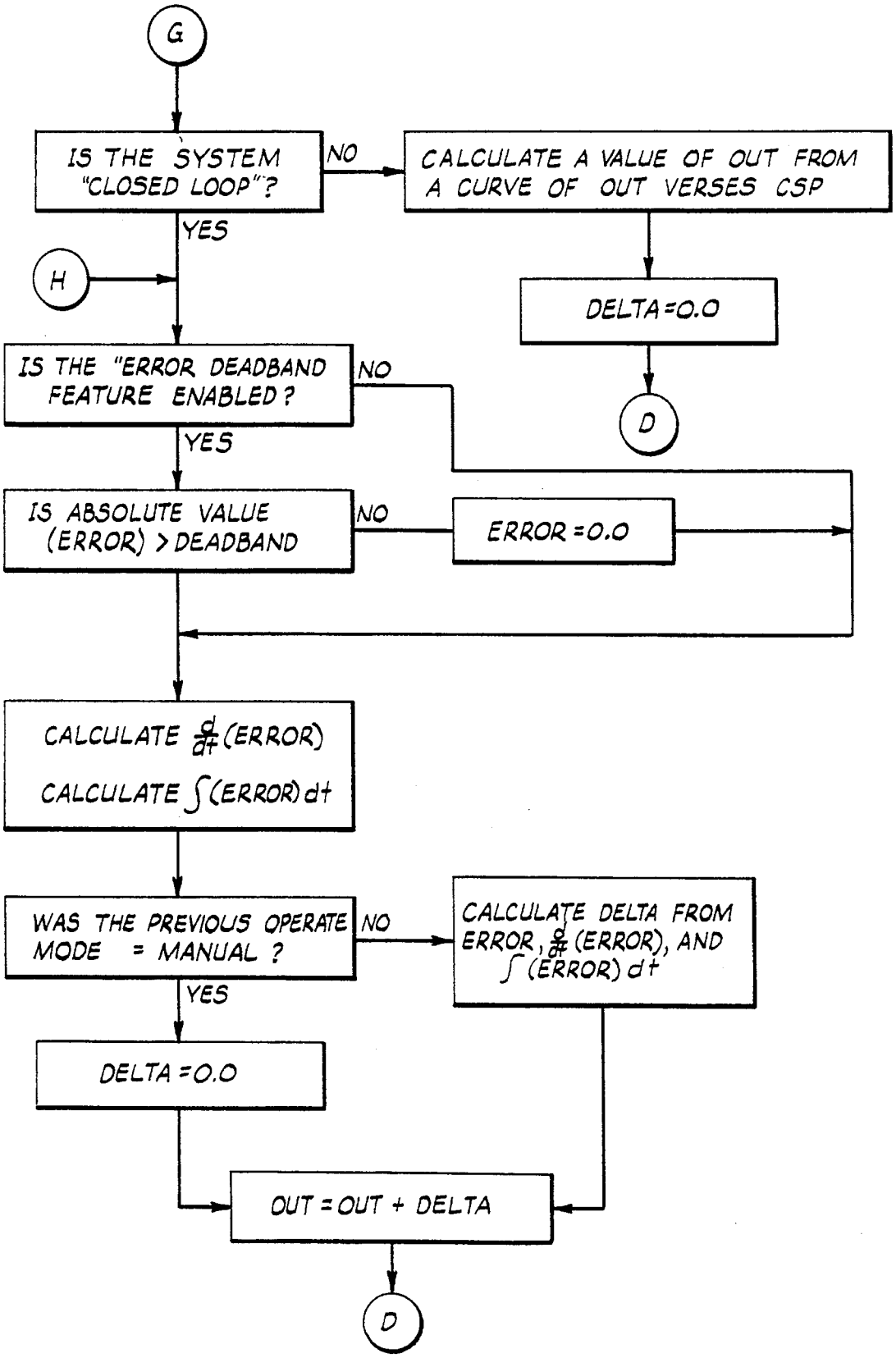
Figure 10F:
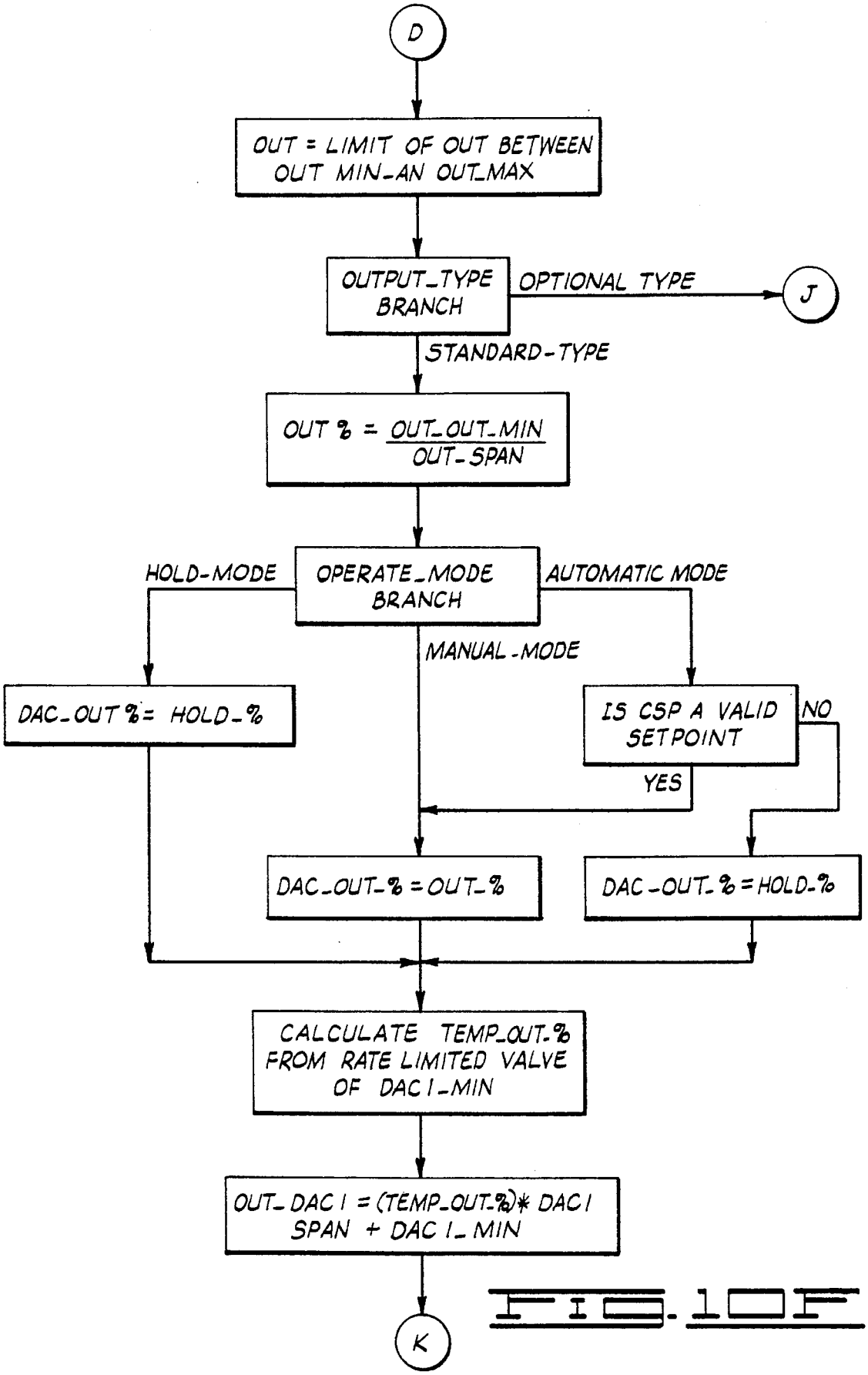
Figure 10G:
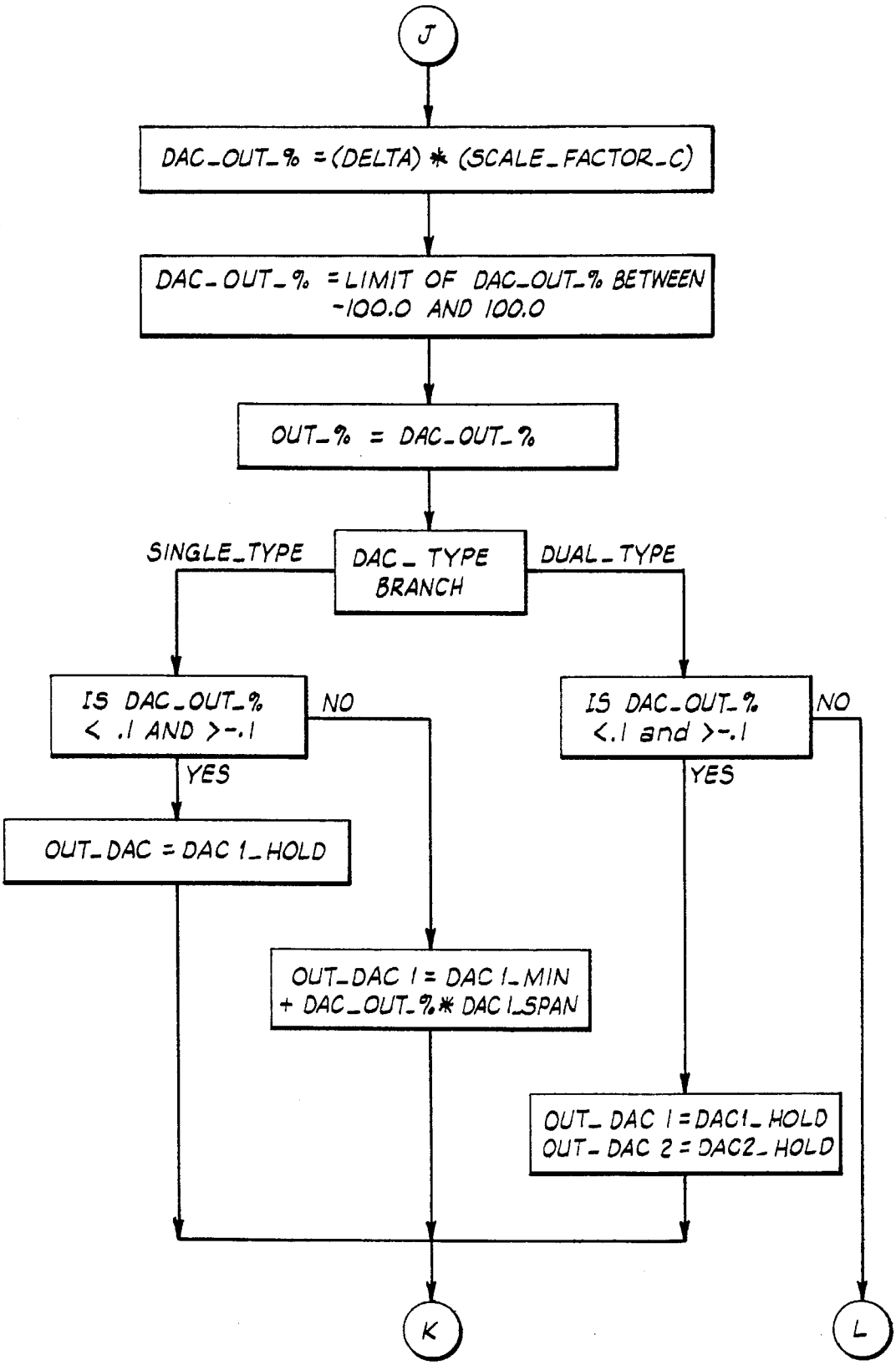
Figure 10H:
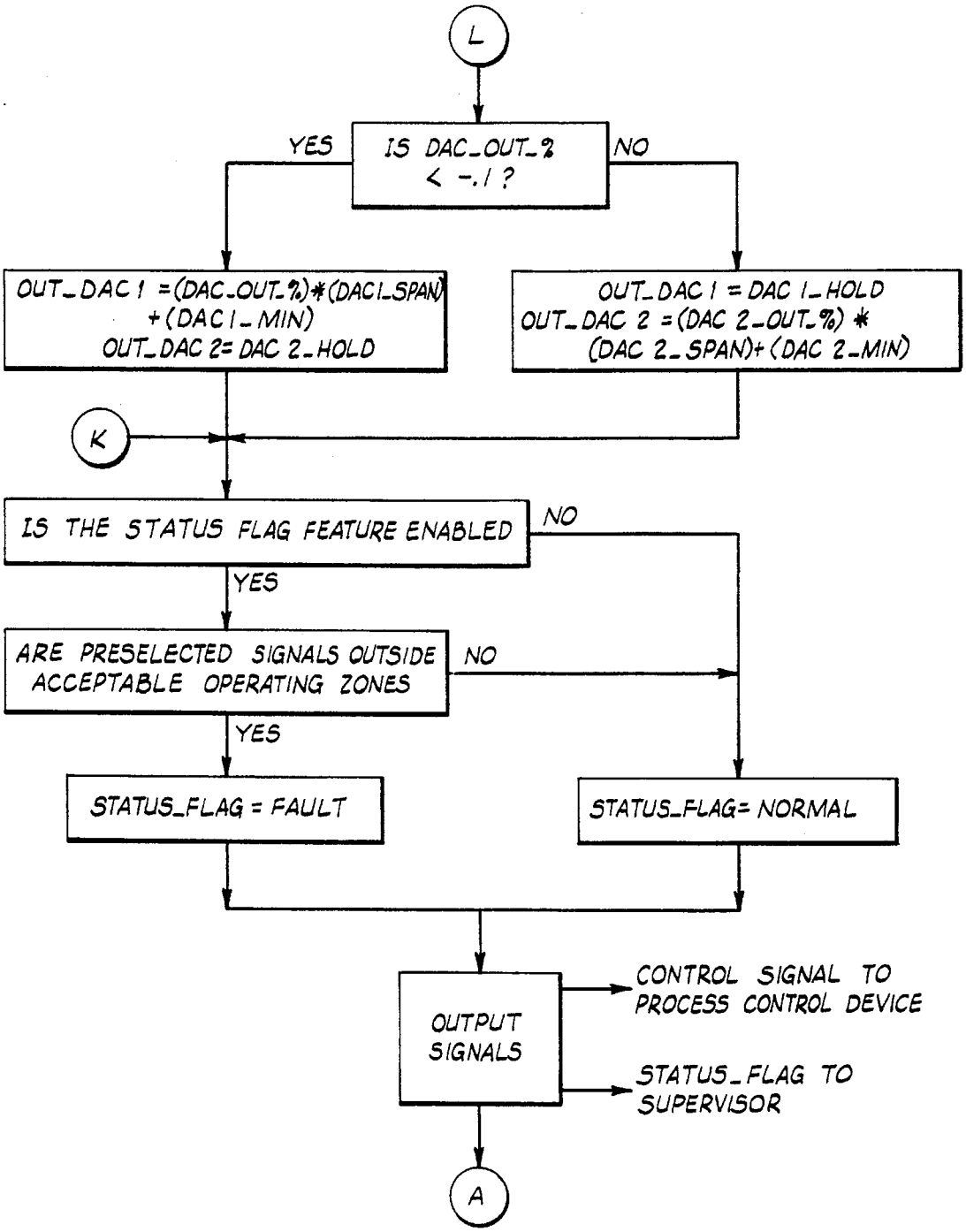

The following description of the automatic control is made with reference to FIGS. 8A and 8B and FIGS. 9A–9E. FIGS. 8A and 8B flow chart control from a supervisor controller 46 through essential material controllers 48 and additive controllers 50. FIGS. 8A and 8B specifically show additive controllers 50 slaved to respective "parent" essential material flows. FIGS. 9A–9E show further aspects of the automatic control method, including tub level and density control features (FIGS. 9B–9D) and a more generalized parent flow for an additive wherein one or more flow rates can be used to define the respective parent flow (FIG. 9E).

One or more slurry recipes which contain the desired absolute mass percentages of the essential dry materials, the desired absolute mass percentages of the essential fluids, the desired mass concentrations of the dry additives, and the desired mass concentrations of the liquid additives are entered in a conventional manner into the supervisor controller 46. The expected density and downhole flow rate of the slurry are also entered into the supervisor controller 46 with each slurry recipe. If tub level control is used, a respective desired tub level setpoint is also entered.

The mass concentration setpoints of the dry and liquid additives are assigned to a "parent" flow. A parent flow can be any desired flow within the system to which the additive is slaved. Examples include one or more flows of the essential materials, other additives and the overall slurry. An essential material is preferably referenced to a slurry flow rate factor (either desired or actual flow rate), and the essential material can have none, one, or multiple dry or liquid additives assigned to it. All dry or liquid additives, however, must be assigned to a parent flow. The mass concentration setpoint for each additive can be calculated as follows: additive mass concentration setpoint = additive mass percentage/parent mass percentage.

The supervisor controller 46 can be implemented by any suitable device or devices, whether hardwired, software or firmware programmed, or customized integrated circuitry. Specific digital computer implementations include IBM PC and compatible computers, programmable logic controllers (PLCs), and Halliburton Services UNI-PRO I, UNI-PRO II, and ARC Unit Controller devices.

After a recipe or multiple recipes are entered into the supervisor controller 46, one recipe is selected as the "active" recipe. Any preentered recipe can later be made the active recipe when desired by the system operator via keypad/keyboard operation, for example.

The active recipe may be modified at any time by the system operator without selecting a preentered recipe as the new active recipe. The active tub level setpoint may also be changed at any time by the system operator.

The recipes and tub level setpoint entered into the supervisor controller 46 will usually be entered locally, but depending upon the hardware used to implement this control system, they may also be remotely entered and modified thus allowing remote operation of the multi-component slurrying process.

The multiple recipe feature of the control system is an optional mode of the system which may not be implemented in a system using UNI-PRO I process control units or UNI-PRO II process control units. This feature will be implemented if a Halliburton Unit Controller or a process controller with the appropriate processing capabilities is used in the system design.

With an active recipe selected, the supervisor controller 46 will enter a start up mode upon operator (or other defined) command. During start up mode, the supervisor controller 46 manages the initial filling of the mixing unit 1. This is a batch mode operation wherein the desired total volume is calculated from the entered tub level setpoint and the geometry of the particular tub 4 (or other container). The amounts for each of the essential materials and additives are determined from their respective setpoints and the calculated total volume. Their respective metering and conveying means are operated to load the computed total amounts in the tub 4, wherein they are mixed into the initial or start up batch. Once this is accomplished, the supervisor controller 46 awaits further operator (or other defined) input instructing it to commence a main operate mode. Although the main operate mode can be in one of three states (hold, which is an off or default state; manual, wherein an operator controls an output control signal; and automatic) as to any one essential material or additive, only the automatic state is of interest here.

In the automatic state of operation wherein continuous mixing is automatically obtained, the supervisor controller 46 calculates from the active slurry recipe and a selected downhole flow rate a mass flow rate setpoint for each essential dry material and a mass flow rate setpoint for each essential fluid. Mass flow rate setpoints are preferably used in the performance of the control method as opposed to volumetric flow rate set points because of the possibility of bulk density changes in the dry material. Broader aspects of the control method do, however, encompass volumetric or other types of control parameters. In a flow mode where a fixed flow of material is desired, the desired flow is provided. In a ratio mode where the material is to be added relative to an overall slurry flow rate factor, an equation for computing an essential material mass flow rate setpoint is: essential material mass flow rate setpoint=(measured or calculated mass flow rate of slurry)×(material mass %)×(correction factor), where the measured mass flow rate of slurry is a sensed parameter, the calculated mass flow rate of slurry=(the preentered expected slurry flow rate)×(the preentered slurry design density), the material mass % is the preentered value for the respective essential material, and the correction factor is 1 or determined by multiplying subsequently described tub level and density control factors. The measured, or actual, mass flow rate of slurry may be used, for example, when the slurry is to be pumped as fast as possible under a preset pumping pressure setpoint. The calculated mass flow rate is used when a specific flow rate of slurry is desired.

If the automatic tub level control feature of the supervisor controller 46 is enabled, the supervisor controller 46 compares the actual, measured slurry level in the tub to the desired tub level setpoint and automatically makes mass flow rate setpoint adjustments to the essential materials as needed in the process of maintaining a constant mixing tub level. The adjustment of the selected mass flow rate setpoints can also be done manually by the system operator if so desired. The adjustment to obtain desired tub level can also be made via control of the output slurry pump rate. The automatic tub level feature is an optional feature.

If an optional automatic density correction feature is enabled, the supervisor controller 46 compares the actual slurry density to the desired slurry density setpoint and makes mass flow rate setpoint adjustments to one or more preselected essential materials as needed for maintaining the desired slurry setpoint. These adjustments can also be done manually by the system operator if desired. This automatic density correction feature is an optional feature.

If both tub level control and density control are used, they can be implemented in the essential material mass flow rate setpoint calculation via the "correction factor" referred to above. The values for these two controls are computed and then multiplied to define the correction factor. If the actual slurry level and density are at their respective setpoints, the product will be 1; whereas if one or both of the actual values are not at their respective setpoint, a value greater or less than 1 will be generated as the product depending on which way the level of slurry in the tub and/or density deviate from their setpoints. Either of these factors can be set to 1 if the respective control is not to be implemented or made effective.

With the mass flow rate setpoints for the essential dry and liquid materials calculated and the concentration setpoints for the additives entered, these setpoints are passed to the respective dry/liquid material controllers 48 and dry/liquid additive controllers 50. This distributed system arrangement enables control to be maintained even if subsequent signals from the supervisor controller 46 are lost.

Upon receiving a valid essential material mass flow rate setpoint from the supervisor controller 46, a dry/liquid material controller 48 provides and adjusts an output control signal to the respective dry/liquid material metering system (i.e., a respective one of the metering and conveying means 14, 18 in FIG. 1) in the process of matching the measured actual mass flow rate of the essential material to the desired mass flow rate setpoint. The measured mass flow rate is obtained from the respective metering and conveying means 14 or 18, specific examples of which are given above. More generally, the measured flow rate can be an actual measured signal from a mass flow rate device or a calculated mass flow rate from a volumetric measuring device or a calculated mass flow rate from a volumetric metering device. There is a respective material controller 48 for each essential dry material 6 and its associated metering and conveying means 14 and for each essential fluid 10 and its associated metering and conveying means 18.

If a device or method is unavailable to accurately measure or calculate the mass flow rate of a dry/liquid material, or if the measured mass flow rate feedback is not received or is invalid, the dry/liquid material controller 48 may operate "open loop" without the measured mass flow rate signal. The material controller 48, under these circumstances, sends an output signal to the dry/liquid material metering system as calculated from an output signal to mass flow rate setpoint curve or relationship that has been preentered, such as in response to a calibration procedure.

If the respective dry/liquid material controller 48 is unable to maintain its actual mass flow rate within a pre-programmed error band of the setpoint, the supervisor controller 46 is flagged via the dry/liquid material controller's status line. Once flagged, the supervisor program takes appropriate actions to remedy the problem and also notify the system operator. The status line feature of the dry/liquid additive controller is an optional feature.

From the foregoing, the automatic control method comprises: continuously flowing a plurality of substances into a mixer, and controlling the flowing of the plurality of substances in response to respective predetermined flow setpoints for each of the plurality of substances. These substances include at least an essential dry material and an essential liquid material; however, as previously explained as to the overall process there is at least a third essential material, for which there is a respective material controller 48 as represented in FIGS. 8A and 8B by the Referring to the additive controllers 50, each can be used in any application where a respective additive is to be added to the process at a rate proportional to a parent flow. As shown in FIGS. 8A and 8B, a parent flow can be a single measured essential material mass flow rate. As shown in FIG. 9E, however, multiple flow rates can be used to define a parent flow to which the respective additive is ratioed. Such multiple flows can include, for example, the actual flow rates of essential material, other additives, and the slurry.

Each additive controller 50 has a setpoint entered as an additive concentration, and then the controller 50 controls delivery rate such that concentration of the additive in the process fluid is accurately maintained. Such additive control requires the following input signals: the master flow rate(s) for the parent flow or the resultant ratio variable calculated therefrom, the setpoint entered as a concentration (e.g., gallons/thousand gallons, pounds/barrel, etc.), and the actual mass flow rate of the additive. It provides as its output an analog signal proportional to the desired additive mass flow rate; however, other types of output control signals can be used (e.g., pulse width modulation).

Upon receiving a valid concentration setpoint from the supervisor controller 46, a dry/liquid additive controller 50 uses this setpoint along with the parent flow information to calculate a mass flow rate setpoint for the respective dry/liquid additive. An equation for doing this is: additive mass flow rate setpoint=(parent mass flow rate)×(additive mass concentration setpoint). After the desired mass flow rate setpoint of the dry/liquid additive is calculated, the respective dry/liquid additive controller 50 provides and adjusts an output control signal to the respective dry/liquid additive metering system 16 or 20 of the FIG. 1 system in the process of matching the measured actual mass flow rate to the desired mass flow rate setpoint. The measured mass flow rate is obtained from the respective metering and conveying means 16 or 20, specific examples of which are given above. More generally, the measured mass flow rate can be an actual measured signal from a mass flow rate device or a calculated mass flow rate from a volumetric measuring device or a calculated mass flow rate from a volumetric metering device. There is a respective additive controller 50 for each additive 8, 12 and its associated metering and conveying means 16, 20.

If a device or method is unavailable to accurately measure or calculate the mass flow rate of a dry/liquid additive, or if the measured mass flow rate feedback is not received or is invalid, the dry/liquid additive controller 50 may operate "open loop" without the measured mass flow rate signal. The additive controller 50, under these circumstances, sends an output signal to the dry/liquid additive metering system as calculated from an output signal to mass flow rate setpoint curve or relationship that has been preentered, such as in response to a calibration procedure for the respective additive metering device. Using this feature, the control method includes a step of flowing the additive including: generating a control signal in response to a concentration setpoint for the additive and an actual flow rate for a predetermined parent flow; operating, in response to a valid feedback signal indicating actual flow of the additive through a metering device communicating with the additive, the additive metering device under closed loop control using the control signal and the feedback signal; and operating, in response to an invalid feedback signal, the additive metering device under open loop control using the control signal and a predetermined response characteristic of the additive metering device. An example of such open loop control is disclosed in U.S. patent application Ser. No. 07/955,531 filed Oct. 1, 1992, assigned to the assignee of the present invention and incorporated herein by reference. The same type of control can be used with the essential materials as indicated above.

If the respective dry/liquid additive controller 50 is unable to maintain its actual mass flow rate within a pre-programmed error band of its setpoint, the supervisor controller 46 is flagged via the dry/liquid additive controller's status line. Once flagged, the supervisor program takes appropriate actions to remedy the problem and also notify the system operator. The status line feature of the dry/liquid additive controller is an optional feature.

From the foregoing, the automatic control method further comprises: continuously flowing a plurality of additives for mixing with the plurality of essential materials; and controlling the flowing of the plurality of additives in response to respective predetermined additive setpoints for each of the plurality of additives, including determining each respective predetermined additive setpoint in response to the respective flow rate for a respective parent flow.

The foregoing steps are repeated until the mode of operation for the supervisor controller 46 is changed.

As with the supervisor controller 46, the dry/liquid material controllers 48 and the dry/liquid controllers 50 can be implemented by any suitable means. These can include one or more portions of the means implementing the supervisor controller 46 or separate means. Examples of software/firmware-implemented entities are UNI-PRO I units, UNI-PRO II units, ARC Unit Controller or a mix of these controllers. Control hardware other than Halliburton Services designed controllers, such as PC based or PLC based systems, are examples of other means for implementing the control system. If implemented within multiple hardware units, most major functions of the supervisor controller can be distributed among the various hardware units with some functions being duplicated among the multiple hardware units. As noted previously, certain features of the control system are optional features depending upon the control hardware used to implement the system. If adequate processing power and adequate input/output are available, then the various optional features of the control system can be enabled.

From the foregoing, the control method can be stated as a method of controlling a continuous multi-component slurrying process at an oil or gas well, comprising: continuously flowing a fluid for a slurry in response to a slurry flow rate factor; continuously flowing a dry material for the slurry in response to the slurry flow rate factor; and continuously flowing an additive for the slurry in response to a flow rate of at least a predetermined one of the fluid and the dry material. The method preferably further comprises: measuring the density of the slurry; comparing the measured density and a predetermined desired density; and changing the flows of the fluid and dry material in response to the comparison of the measured density with the desired density.

The method preferably further comprises: measuring the slurry level in the mixing tub; comparing the measured level to a predetermined desired slurry level setpoint; and changing the mass flow rates of the fluid and the dry material in response to both the comparison of the measured density with the desired density and the comparison of the measured tub level and the desired tub level.

Stated another way, the control system provides a method of controlling a continuous process for making a multi-component slurry at an oil or gas well, comprising: adding a liquid material into a mixer, adding a dry material into the mixer, and adding an additive into the mixer, wherein each of these adding steps includes further steps as follows. Adding a liquid material includes: computing a mass flow rate setpoint for the liquid material in response to a predetermined absolute mass percentage for the liquid material, a predetermined desired density for the slurry, and a predetermined desired flow rate of the slurry into the oil or gas well; and flowing the liquid material in response to the computed mass flow rate setpoint for the liquid material. Adding a dry material into the mixer includes: computing a mass flow rate setpoint for the dry material in response to a predetermined absolute mass percentage for the dry material, the predetermined desired density for the slurry, and the predetermined desired flow rate of the slurry into the oil or gas well; and flowing the dry material in response to the computed mass flow rate setpoint for the dry material. Adding an additive into the mixer includes: computing a mass flow rate setpoint for the additive in response to a predetermined mass concentration for the additive and the mass flow rate for a predetermined parent flow; and flowing the additive in response to the computed mass flow rate setpoint.

For software/firmware implemented systems, any suitable type of programming can be used. In the preferred embodiment, proportional-integral-derivative (PID) control is implemented. Examples of other control techniques include, without limitation, fuzzy logic, sliding mode, expert system, adaptive control and neural net.

The general control program of the preferred embodiment is a feedback control algorithm designed to run in the Halliburton Services UNI-PRO II multitasking process controller. Multiple copies of this program can run simultaneously providing control of several subsystems of the overall process system from a single unit. The UNI-PRO II also provides connections to the outside world, including analog inputs, digital inputs, analog outputs, digital outputs and the operator interface in a compact, mobile package.

This general control program is based on the error-driven proportional, integral and derivative type feedback controller that is widely used wherein an error signal used for corrective control is the difference between the setpoint, or desired value, and the actual value as determined from a measurement indicating the flow rate of the substance. The resulting program is flexible and can be used to control most types of systems encountered in the oil and gas industry. A specific program that can be used is the Halliburton Services GPID program. A flow chart of such program as adapted for implementing the foregoing operate mode is shown in FIGS. 10A–10I.

Particular capabilities of a particular implementation include:

1. Three operating modes: "Hold mode" is an off or default state; "manual mode" allows the operator to directly control the output control signal; and "automatic mode" uses the programmed technique to maintain the respective setpoint.
2. Three primary input variable options: A "setpoint" is the desired value, a "process variable" is the value of the system state, and a "ratio variable" is used when the desired state is proportional to some other system variable. All of these values can be provided by analog or digital signals from the outside world or they can be calculated by another program running simultaneously or entered by the operator using a data entry means such as a keypad.
3. Feedback options: Feedback control can be performed using any combination of proportional, integral, or derivative terms of the error.
4. Output offset: This feature allows the user to set a starting output level. The program then drives the process to the respective setpoint from this value. This gets the system to setpoint faster because the process is brought much closer to its final condition before the controller begins to reduce the level of error. This is also useful in situations where the starting torque on a hydraulic motor, for example, is significantly greater than the torque required for the setpoint condition.
5. Output control signal type:
   a) One option is for a standard output control signal which is normally used with process control devices which do not time-integrate their input control signal. This type of control device requires a constant input control signal if the process is to be maintained at a value other than zero. Examples of this type of control device include a pump speed controller, motor speed controller, and valve positioner with closed loop position control. The standard output signal, when used to control these types of devices, is proportional to the desired speed or position of the process being controlled. This proportional signal can be described as "prior signal + delta" where "delta" is an additional correction made for any sensed error between the actual and desired values of the process being controlled.

b) A second option is for an optional control signal to be used with process control devices which time integrate their input control signal. This type of process controller will maintain its controlling process at the value obtained from its previous input control signal. An example of this type of process controller is a directional valve controlled rotary actuator system without closed loop position control. When a control signal is sent to the rotary actuator system, it will rotate to a new position and hold that position until it receives a new control signal input. In this case the output control signal from the process controller is used to bump open or bump close the rotary actuator to a new desired position (such a signal is simply the "delta" portion of the standard output control signal). This option also allows for two analog output channels to be used independently to make the positive and negative changes to the desired process if the process control device so requires.

These two types of output control signals are referred to in U.S. patent application Ser. No. 07/822,189 filed Jan. 16, 1992, assigned to the assignee of the present invention and incorporated herein by reference. Using this selectable control signal feature, the step of flowing the additive in the control method includes: determining whether an additive metering device communicating with the additive and used for controlling the amount of additive added requires a first type of control signal or a second type of control signal; and generating a control signal for the additive metering device in response to a calculated mass flow rate setpoint, an actual flow rate for the predetermined parent flow, and the determination of whether a first type of control signal or a second type of control signal is required.

6. Signal damping: This option is a filter to reduce effects of noisy signals on signals for the ratio and process variables.

7. Range checking and diagnostics: This checks the validity of incoming signals against a range set by the user. When an out of limit condition occurs, a flag is set that can be used by other routines to either perform actions or trigger alarms.

8. Two display options: The numeric value of any of the variables used by the program, including setpoint, process variable, error, output, or ratio variable can be displayed. A bar graph of the error or output can also be displayed.

9. Output rate limiting: This feature limits the rate at which the output signal can change. This is used when it is desired not to make sudden changes to the system that it cannot handle smoothly (e.g., preventing water hammer, decelerating high inertial loads).

10. Remote operation: The process can be operated remotely using analog or digital signals to guide its operation.

11. Ratiometric control: This is for control of processes that are controlled as a concentration to some other process variable. For example, control of a liquid additive rate that is delivered as a concentration to a master flow rate.

12. Bumpless transitions between operating modes: This feature allows the operator to change between manual and automatic modes of operation without introducing catastrophic changes to the system. Using this feature, the step of flowing an additive includes automatically controlling an additive metering device communicating with the additive for controlling the amount of additive added without an operator of the process manually controlling the additive metering device. In conjunction with this, the method further comprises: selectably disabling the automatic control for the additive metering device and enabling bumpless manual control for the additive metering device wherein the operator manually adjusts the additive metering device from the last state of automatic control of the additive metering device prior to disabling the automatic control; and selectably disabling the manual control for the additive metering device and enabling bumpless automatic control for the additive metering device from the last state of manual control of the additive metering device prior to disabling the manual control. See U.S. patent application Ser. No. 07/822,189 filed Jan. 16, 1992, assigned to the assignee of the present invention and incorporated herein by reference.

13. Deadband: This option creates a band about a respective setpoint that is accepted as a zero error zone. This makes for smooth operation near setpoint and reduces effects of noise.

This program can be used for virtually any application where single input-output PID control will work. This includes valve positioning, liquid additive and dry additive proportioning, pump speed, etc. It eliminates the need for specialized programs in most control applications.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A process for continuously mixing a settable mud at an oil or gas well, comprising:

(a) flowing a dilution fluid directly into a mixing unit at the oil or gas well;

(b) concurrently with said step (a) but in a separate stream from the dilution fluid,_ flowing a drilling fluid directly into the mixing unit;

(c) concurrently with said steps (a) and (b) but in a separate stream from the dilution fluid and the drilling fluid, flowing a cementitious substance directly into the mixing unit; and (d) mixing the dilution fluid, the drilling fluid and the cementitious substance in the mixing unit.

2. A process as defined in claim 1, wherein:

said process further comprises before said steps (a), (b), (c) and (d):

flowing a fluid medium into the mixing unit;

flowing a viscosity control agent into the mixing unit;

flowing a density control agent into the mixing unit;

mixing the fluid medium, the viscosity control agent and the density control agent in the mixing unit into a drilling fluid to be pumped into the well;

pumping the drilling fluid of the preceding step into the well; and returning at least a portion of the pumped drilling fluid from the well and flowing the returned portion into a storage facility; and said step (b) includes using at least a portion of the drilling fluid from the storage facility.

3. A process as defined in claim 2, wherein using at least a portion of the drilling fluid from the storage facility includes using at least a portion of the drilling fluid without substantially increasing the volume of the portion.

* * * * *